US006363898B1

(12) United States Patent
Ripma et al.

(10) Patent No.: US 6,363,898 B1
(45) Date of Patent: Apr. 2, 2002

(54) QUICK REPLACEMENT IGNITER ASSEMBLY

(75) Inventors: Gordon R. Ripma, Tequesta; William P. Strait, Jupiter, both of FL (US); Brian E. Ainsworth, Ada, MI (US)

(73) Assignee: Quik-Change International, LLC, Tequesta, FL (US)

( * ) Notice: Subject to any disclaimer, the term of this patent is extended or adjusted under 35 U.S.C. 154(b) by 0 days.

(21) Appl. No.: 09/614,676

(22) Filed: Jul. 12, 2000

Related U.S. Application Data

(63) Continuation-in-part of application No. 09/414,000, filed on Oct. 7, 1999, now Pat. No. 6,152,095, and a continuation-in-part of application No. 09/414,753, filed on Oct. 7, 1999, which is a continuation-in-part of application No. 09/006,378, filed on Jan. 13, 1998, now Pat. No. 5,979,387, which is a continuation-in-part of application No. 08/749,334, filed on Nov. 14, 1996, now Pat. No. 5,706,847.

(51) Int. Cl.[7] ..... H01T 13/08; H01T 13/56

(52) U.S. Cl. ..... 123/169 R; 123/142.5 E; 123/145 A; 123/143 R; 313/135

(58) Field of Search ..... 123/169 R, 169 PA, 123/169 PH, 169 EL, 169 EC, 142.5 E, 145 A, 143 R; 313/139, 143, 148, 135

(56) References Cited

U.S. PATENT DOCUMENTS

| | | | | |
|---|---|---|---|---|
| 4,434,758 A | | 3/1984 | Grammes | 123/286 |
| 4,814,664 A | | 3/1989 | Rothenbuhler | 313/131 R |
| 5,280,214 A | | 1/1994 | Johnson | 313/139 |
| 5,402,637 A | | 4/1995 | Adam | 60/39.287 |
| 5,430,346 A | | 7/1995 | Johnson | 313/139 |
| 5,676,100 A | | 10/1997 | Dam et al. | 123/145 A |
| 5,834,736 A | | 11/1998 | Kawamura | 219/270 |
| 5,839,403 A | * | 11/1998 | Grant et al. | 123/169 R |
| 5,862,786 A | | 1/1999 | Fuchs et al. | 123/142.5 E |
| 5,880,432 A | | 3/1999 | Radmacher | 219/270 |
| 5,947,071 A | | 9/1999 | Alcamo | 123/169 EC |
| 5,979,387 A | * | 11/1999 | Strait et al. | 123/169 PA |
| 6,152,095 A | * | 11/2000 | Ripma et al. | 123/169 R |

* cited by examiner

*Primary Examiner*—John Kwon
*Assistant Examiner*—Hieu T. Vo
(74) *Attorney, Agent, or Firm*—Price, Heneveld, Cooper, DeWitt & Litton

(57) ABSTRACT

A two-piece igniter includes an outer housing that includes a cylindrical member having an outer wall and an inner wall that defines a passage through the outer housing. The igniter further includes a plug member adapted to fit within the passage of the outer housing and that includes an axial electrode and an axially insulating insulator element encircling the axial electrode, the axial electrode having a first end for connection to an electric source and a second end for engagement within a combustion area. The igniter also includes a longitudinally extending biasing member positioned about the plug member. The plug member may be releasably coupled within the outer housing by inserting the plug member within the passage of the outer housing and by manipulating the plug member once inserted.

79 Claims, 15 Drawing Sheets

QUICK REPLACEMENT IGNITER ASSEMBLY

CROSS-REFERENCE TO RELATED APPLICATIONS

This invention is a continuation-in-part of U.S. patent application Ser. No. 09/414,000, filed Oct. 7, 1999, entitled QUICK REPLACEMENT SPARK PLUG ASSEMBLY, now U.S. Pat. No. 6,152,095, issued Nov. 28, 2000, and U.S. patent application Ser. No. 09/414,753, filed Oct. 7, 1999, entitled SPARK PLUG WITH IMPROVED SPARK FORMATION, which are hereby incorporated herein by reference, and which are each a continuation-in-part of U.S. Patent application Ser. No. 09/006,378, filed Jan. 13, 1998, entitled QUICK REPLACEMENT OF SPARK PLUG ASSEMBLY, now U.S. Pat. No. 5,979,387, issued Nov. 9, 1999, which is hereby incorporated herein by reference, and which is a continuation-in-part of U.S. Patent application Ser. No. 08/749,334, filed Nov. 14, 1996, entitled QUICK REPLACEMENT SPARK PLUG ASSEMBLY, now U.S. Pat. No. 5,706,847, issued Jan. 13, 1999, which is hereby incorporated herein by reference.

BACKGROUND OF THE INVENTION

The present invention relates to igniters, and more particularly to igniters for use in gasoline engines, diesel engines and gas turbine engines, and that may be more rapidly and easily replaced in conventional igniters.

Ordinary spark plugs have an external thread on a metal outer housing or shell with a hexagonal head integrally formed with the metal outer shell and adapted for mating with a removal tool such as a socket or a box end wrench. The outer shell is seated in a threaded bore of a cylinder head and may have a deformable gasket seal located between the hexagonal head and the cylinder head, thereby isolating the cylinder chamber. Complete sealing and correct positioning of a spark plug in the combustion chamber requires applying a precise torque to the hexagonal head of the spark plug. Excessive torque or incorrect positioning may strip the threads in the cylinder head, requiring expensive repairs. Space for tools is limited in many engine compartments and access is often awkward. All the problems associated with spark plug replacement are magnified in auto racing competition where engine heat is much greater than in conventional engines and where time constraints are added. Similar problems to those discussed above are associated with the replacement of glow plugs in diesel engine applications and igniters in gas turbine engine applications.

U.S. Pat. No. 5,186,132, issued to Runge teaches a plug-in spark plug that requires a special bore in the cylinder head with a retaining groove for engaging a locking clip. The plug-in spark plug as disclosed in the Runge patent requires some sort of tool fitting in a groove to forcefully pull the plug out and a tool for engaging the clip to the reduce its diameter to disengage it from the retaining area. It would be desirable to have a system that would operate with conventional bored and threaded engine components, since it would be impractical for engine manufacturers to provide specially designed engine components.

U.S. Pat. No. 3,747,583, issued to Georges and Spangler teaches a quick insertion spark plug arrangement in which an outer sleeve screws into the threaded bore in a cylinder head. The sleeve has an inner profile that cooperates with an outer profile of a plug. When in a first rotary position, the plug may be moved axially into and out of the sleeve. When the inserted plug is a second rotary position, the outer profiles cooperate to lock the position of the plug against axial movement, thus preventing the spark plug from being axially removed from within the sleeve. The spark plug as disclosed by Georges and Spangler does not prevent rotational movement of the plug from within the sleeve towards an unlocked position.

Quick disconnect couplings for joining conduits for high pressure fluids are exemplified in U.S. Pat. No. 3,162,470, issued to Davidson, and SWAGELOK (registered trademark) fluid flow quick-connect coupling QF series made by the SWAGELOK Company of Hudson, Ohio. Each of these couplings as disclosed include a hand-operated sliding lock sleeve that requires no tool for engagement and disengagement. This style of connection has not been applied to spark plugs, glow plugs, or gas turbine igniters.

SUMMARY OF THE INVENTION

One aspect of the present invention is to provide a two-piece igniter that includes an outer housing that includes a cylindrical member having an outer wall and an inner wall, the inner wall defining a passage through the outer housing, and having a first profile having at least one undercut section and defining a first diameter, and a second profile defining a second diameter. The igniter further includes a plug member adapted to fit within the passage of the outer housing and that includes an axial electrode and an electrically insulating insulator element encircling the axial electrode. The axial electrode includes a first end for connection to an electric source and a second end for engagement within a combustion area. The plug member is provided a first profile and a second profile, the second profile adapted to be received within the undercut section of the first profile of the outer housing. The plug member may be releasably coupled within the outer housing by inserting the plug member within the passage of the outer housing and turning the plug member with respect to the outer housing, thereby locating the second profile of the plug member within the undercut section of the first profile of the outer housing. The biasing member biases the second profile of the plug member into engagement with the undercut section of the first profile of the outer housing.

Another aspect of the present invention is to provide a method of coupling a two-piece igniter that includes providing an outer housing including a cylindrical member having an outer wall and an inner wall that finds a passage through the outer housing, wherein the inner wall has a first profile defining a first diameter and a second profile defining a second diameter, and the first profile has at least one inwardly extending step. The method further includes providing a plug member adapted to fit within the passage of the outer housing, wherein the plug member includes an axial electrode and an electrically insulating insulator element encircling the axial electrode. The axial electrode has a first end for connection to an electric source and a second end for engagement within a combustion area, and the plug member has a first profile defining a first diameter and a second profile defining a second diameter. The method also includes providing a longitudinally extending biasing member positioned about the plug member and adapted to two outwardly bias the plug member from within the outer housing, inserting the plug member within the passage of the other housing, and exerting an inwardly directed force on the plug member, thereby depressing the biasing member. The method still further includes turning the plug member with respect to the outer housing until the second profile of the plug member is rotated beyond the at least one step of the outer housing, and releasing the inwardly directed force on the plug, such that the at least one step of the outer housing restricts the plug member from being rotated with respect to the outer housing.

Another aspect of the present invention is to provide a two-piece igniter that includes an outer housing that includes a cylindrical member having an outer wall and an inner wall, the inner wall defining a passage through the outer housing. The outer housing further includes at least one biasing member and at least one engagement member inwardly biased by the biasing member such that the engagement member moveably extends within the passage. The igniter further includes a plug member adapted to fit within the passage of the outer housing and that includes an axial electrode and an electrically insulating insulator element encircling the axial electrode. The axial electrode has a first end for connection to an electric source and a second end for engagement within a combustion area. The insulator element includes a circumferentially extending annular groove adapted to receive the engagement member of the outer housing therein. The plug member may be releasably coupled within the outer housing by inserting the plug member within the base of the outer housing to an engagement position wherein the engagement member of the outer housing engages the annular groove of the insulator element of the plug member. The plug member may be uncoupled from within the outer housing by inserting the plug member beyond the engagement position and then removing the plug member from within the outer housing.

Yet another aspect of the present invention is to provide a two-piece igniter that includes an outer housing including a cylindrical member having an outer wall and an inner wall that defines a passage through the outer housing and that has at least one inwardly extending first projection. The igniter also includes a plug member adapted to fit within the passage of the outer housing and that includes an axial electrode and an electrically insulating insulator element encircling the axial electrode, the axial electrode having a first end for connection to an electric source and a second end for engagement within the combustion area. The plug member has at least one outwardly extending second projection adapted to engage the first protection of the outer housing. The igniter further includes a longitudinally extending biasing member positioned about the plug member and exerting both a linear and rotation force on the plug member as the biasing member is compressed. The plug member may be releasedly coupled within the outer housing by inserting the plug member within the passage of the outer housing and placing an inwardly directed first force on the plug member until the first and second projections are engaged and then releasing the first force. The plug member may be uncoupled from within the outer housing by placing an inwardly directed second force on the plug member until the first and second projections are not engaged and then releasing the second force and removing the plug member from within the outer housing.

Yet another aspect of the present invention is to provide a method that includes providing an outer housing including a cylindrical member having an outer wall and an inner wall that defines a passage through the outer housing and that includes at least one inwardly extending first projection, and providing a plug member adapted to fit within the passage of the outer housing. The plug member includes an axial electrode and an electrically insulating insulator element encircling the axial electrode. The axial electrode has a first end for connection to an electric source and a second end for engagement within a combustion area. The plug member has at least one outwardly extending second projection adapted to engage the first projection of the outer housing. The method also includes providing a biasing member positioned about the plug member and that exerts both a linear and a rotational force around the plug member as the biasing member is compressed, inserting the plug member within the outer housing, and applying an inwardly directed first force to the plug member until the spring aligns the second projection with the first projection, thereby engaging the second projection with the first projection and releasably locking the plug member within the outer housing, and releasing the inwardly directed first force.

Still yet another aspect of the present invention is to provide a method that includes providing an outer housing including a cylindrical member having an outer wall and an inner wall, the inner wall defining a passage through the outer housing, and providing a plug member adapted to fit within the passage of the outer housing including an axial electrode and an electrically insulating insulator element encircling the axial electrode, the axial electrode having a first end for connection to an electric source and a second end for engagement within a combustion area. The method still further includes providing a first biasing member positioned within the plug member, inserting the plug member within the outer housing, applying an axially directed force to the plug member, thereby compressing the biasing member, and releasing the axially directed force, thereby releasably locking the plug member within the outer housing.

These and other features, advantages, and objects of the present invention will be further understood and appreciated by those skilled in the art by reference to the following specification and appended drawings.

DETAILED DESCRIPTION OF PREFERRED EMBODIMENT

Figure 1:
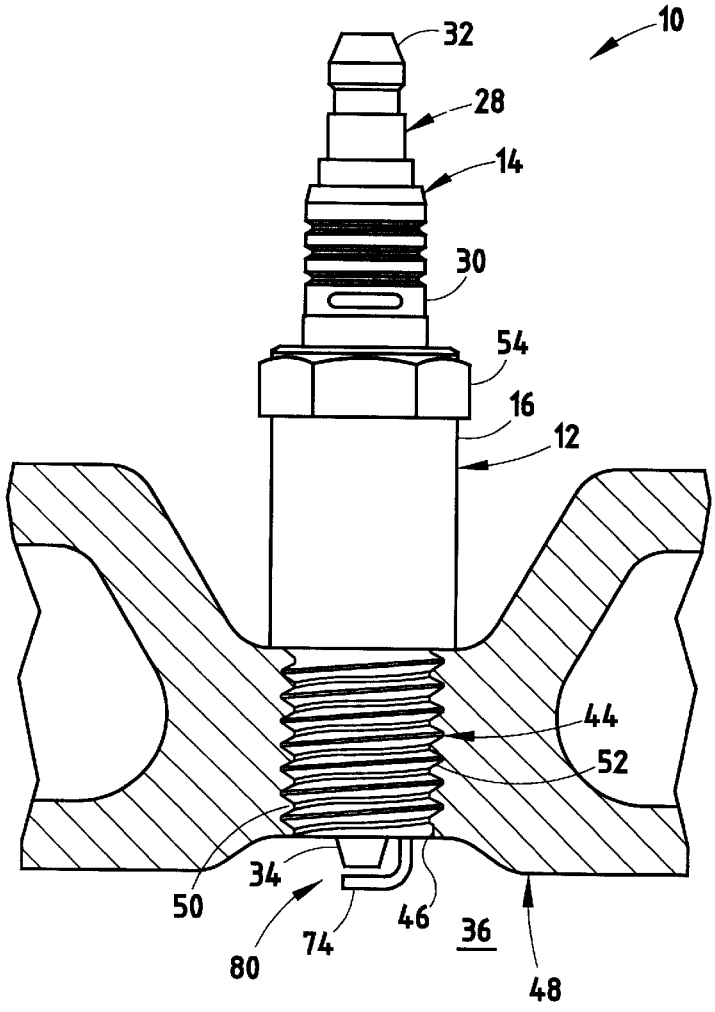
FIG. 1 is a front elevational view of a spark plug of the present invention engaged within a cylinder head of an internal combustion engine.
Figure 2:
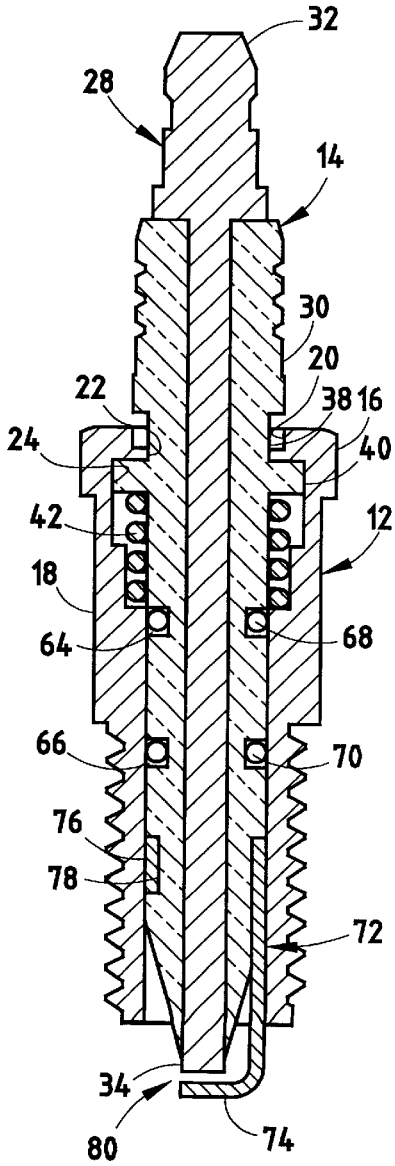
FIG. 2 is a cross-sectional view of the spark plug along its longitudinal axis.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
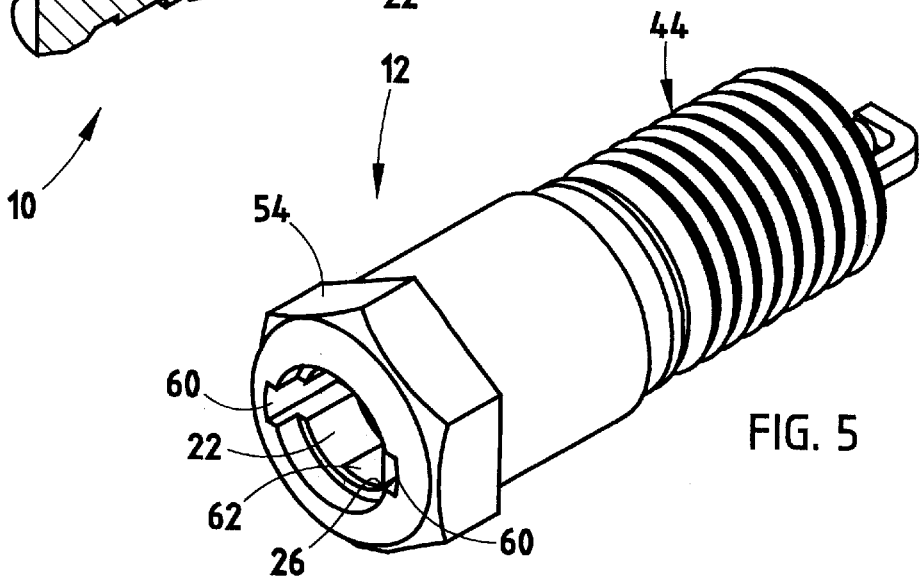
FIG. 5 is a perspective view of an outer member of the spark plug.
Figure 6:
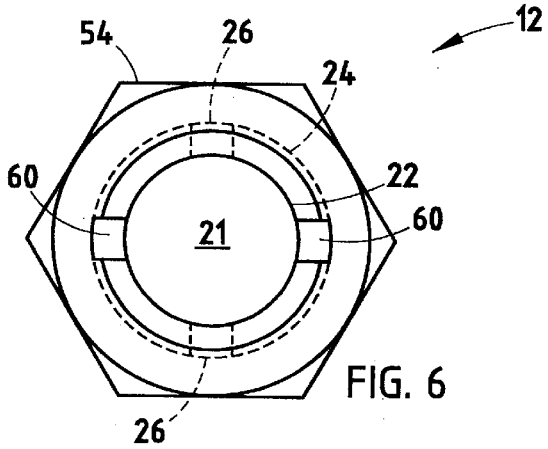
FIG. 6 is a top plan view of the outer member with undercut notches shown in dashed lines.

The reference numeral 10 (FIG. 1) generally designates a two-piece, quick release spark plug embodying the present invention. Spark plug 10 includes a cylindrical body member or outer housing 12 and a cylindrical plug member 14. The outer housing 12 (FIG. 2) includes a cylindrical member 16 that has an outer wall 18 and an inner wall 20. The inner wall 20 defines a passage 21 through outer housing 12. The inner wall 20 has a first profile 22 that defines a first diameter, and a second profile 24 that defines a second diameter. The first profile 22 of outer housing 12 has at least one undercut section 26 (FIG. 6). Each undercut section 26 (FIG. 5) defines a stop wall 62. The plug member 14 is adapted to fit within passage 21 of outer housing 12 and includes an axial electrode 28 and an electrically insulating insulator element 30 encircling axial electrode 28. The axial electrode 28 has a first end 32 for connection to an electric source, and a second end 34 for engagement within a combustion area 36. The plug member 14 has a first profile 38 and a second profile 40. The second profile 40 of plug member 14 is adapted to be received within undercut section 26 of first profile 22 of outer housing 12. The spark plug 10 further includes a longitudinally extending biasing member 42 positioned about plug member 14.

Figure 3:
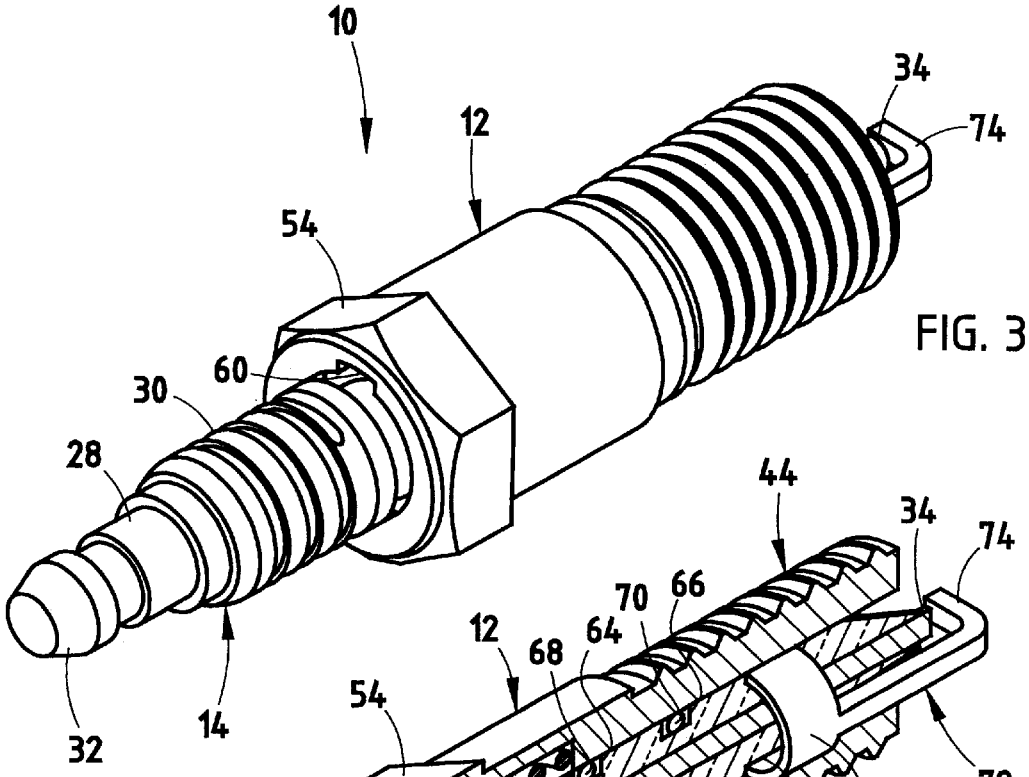
FIG. 3 is a perspective view of the spark plug.

The plug member 14 (FIGS. 1–3) may be releasably coupled with outer housing 12 by inserting plug member 14 within passage 21 of outer housing 12 and turning plug member 14 with respect to outer housing 12, thereby aligning second profile 40 of plug member 14 within undercut section 26 of first profile 22 of outer housing 12. The biasing member 42 biases the second profile 40 of plug member 14 into engagement with undercut section 26 of first profile 22 of outer housing 12.

Electrically and thermally conductive cylindrical outer housing 12 has an inner portion 44 that cooperates with a bore 46 in a cylinder head 48 to form a gas tight and electrically conductive seal between outer housing 12 and cylinder head 48. This may be achieved by cooperating internal threads of bore 46 with external threads 52 of inner portion 44 of outer housing 12. Outer housing 12 is provided with a hexagonally shaped head 54 that is adapted for mating with a conventional socket of box end wrench for inserting and removing outer housing 12 from engagement with cylinder head 48. Alternatively, other means well known in the art such as brazing, welding, and the like may be used to secure outer housing 12 in position within cylinder head 48 as desired, thereby eliminating the need for hexagonal head 54. It should be noted that this arrangement includes integrally forming outer housing 12 with cylinder head 48.

Figure 7:
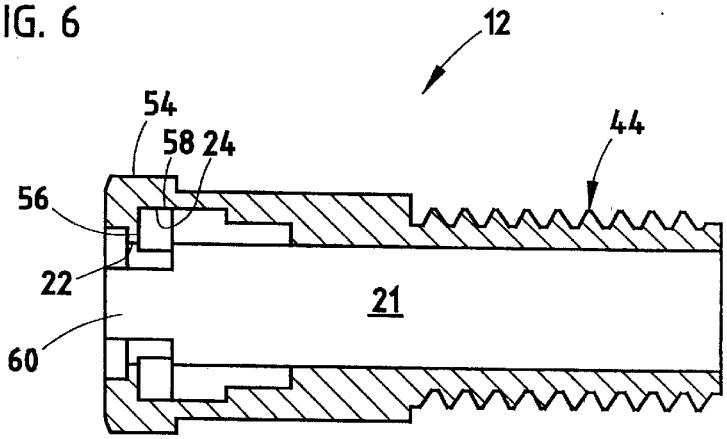
FIG. 7 is a cross-sectional front view of the outer member along its longitudinal axis.

Internal passage 21 of outer housing 12 (FIGS. 5–7) includes first profile 22 and second profile 24. First profile 22 of outer housing 12 defines a circumferentially extending annular lip 56. First profile 22 and second profile 24 of outer housing 12 cooperate to define a circumferentially extending annular groove 58. In the examples illustrated in FIGS. 5–7, a pair of longitudinally extending channels 60 extend from an upper surface 61 of outer housing 12 to lip 56, thereby providing access second profile 24. In the illustrated example, two undercut sections 26 are located approximately 90° from channels 60.

Figure 4:
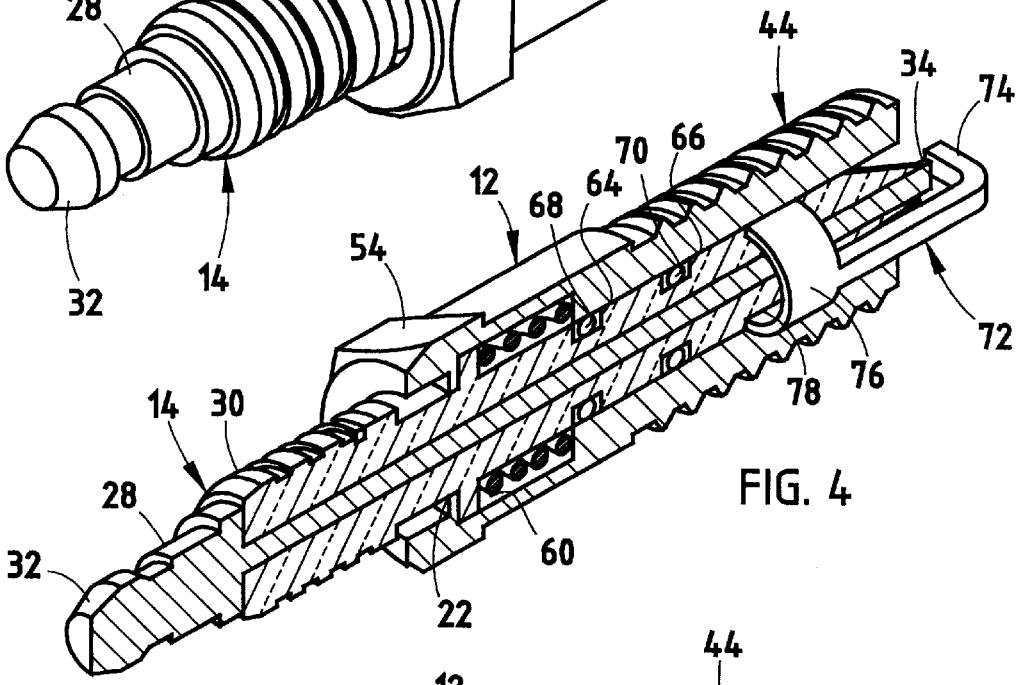
FIG. 4 is a cross-sectional perspective view of the spark plug along its longitudinal axis.

Insulator element 30 (FIGS. 2 and 4) of plug member 14 is constructed of a ceramic material having thermal properties sufficient to withstand temperatures normally associated with the cylinder heads of an internal combustion engine. Further, a high tensile strength fiber reinforced ceramic such as NZP commercially available from LoTech, Inc. of Salt Lake City, Utah, is preferable.

Figure 8:
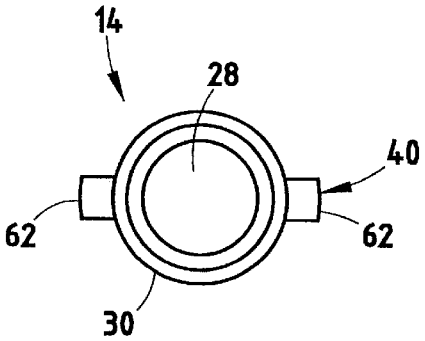
FIG. 8 is a top plan view of a plug member of the spark plug.

Second profile 40 (FIGS. 2 and 8) of plug member 14 is provided in the form of two radially outwardly extending tabs 62 that are adapted to be received within channels 60 and undercut sections 26 of outer housing 12.

Plug member 14 (FIGS. 2 and 4) is further provided with a pair of circumferentially extending annular grooves 64 and 66 that are adapted to receive a pair of annular heat resistant polymer seals 68 and 70 therein, respectively. Seals 68 and 70 may alternatively be constructed from other materials such as synthetic materials and malleable, non-corrosive metals. Alternatively, grooves 64 and 66 and seals 68 and 70 may be replaced with other suitable seal arrangements adequate to prevent the pressure generated within combustion area 36 from escaping through spark plug 10.

Figure 9:
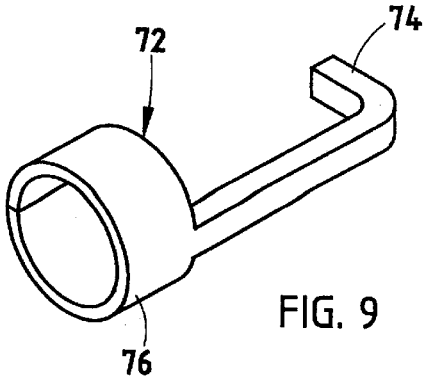
FIG. 9 is a perspective view of a single arm electrode and an associated fire wall.

Plug member 14 further includes an outer electrode or ground electrode 72 (FIGS. 2, 4 and 9) that includes a metal tab 74 located at a distal end and a fire wall 76 located at a proximal end. Outer electrode 72 is constructed of an electrically and thermally conductive material. Prior to assembly within outer housing 12, fire wall 76 and tab 74 of outer electrode 72 are provided in a planar orientation, as discussed below. In assembly, outer electrode 72 is connected with insulator element 38 of plug member 14 by compressing fire wall 76 of outer electrode 72 within a groove 78 located within insulator element 30.

In assembly, plug member 14 is positioned within outer housing 12 such that tabs 62 of plug member 14 are aligned with slots 60 of outer housing 12, thereby allowing plug member 14 to be inserted within outer housing 12. Plug member 14 is inserted within outer housing 12 and an axial force is placed thereon, thereby compressing biasing member or coil spring 42. The axial force is increased until tabs 62 of plug member 14 can access groove 58 of outer housing 12. Plug member 14 is then rotated with respect to outer housing 12 until tabs 62 of plug member 14 are in alignment with undercut sections 26 of first profile 22 of outer housing 12. The insertion pressure being applied against spring 33 is then released, thereby allowing spring 42 to bias tabs 62 of plug member 14 into engagement within undercut sections 26 of first profile 22 of outer housing 12. Stop walls 61, as defined by undercut sections 26 of outer housing 12, prevent plug member 42 from being rotated with respect to outer housing 12, thereby preventing the removal of plug member 14 from within outer housing 12 unless spring 42 is compressed.

To remove and replace plug member 14, an axial force is exerted on plug member 14, thereby inserting plug member 14 within outer housing 12 such that tabs 62 are inserted beyond stop walls 61 of outer housing 12. Plug member 14 is then rotated with respect to outer housing 12 until tabs 62 of plug member 14 are aligned with channels 60, thereby allowing the removal of plug member 14 from within outer housing 12.

In the illustrated example, outer housing 12 includes two longitudinally extending access slots 60 juxtaposed across outer housing 12, and plug member 14 includes two corresponding tabs 62 juxtaposed across plug member 14. The location of slots 60 with respect to tabs 62 require a maximum rotation of 180° of plug member 14 with respect to outer housing 12 to align tabs 62 with slots 60. The outer housing further includes a pair of undercut sections 26 juxtaposed across outer housing 12 and location 90° from the corresponding slots 60. The location of the undercut sections 26 with respect to the slots 60 requires a maximum of 90° of rotation of the plug member 14 with respect to the outer housing 12 between the insertion position and the locked position of plug member 14 within outer housing 12.

The reference numerals 12A and 14A generally designate another embodiment of the outer housing and plug member, respectively, of the present invention. Since outer housing 12A and plug member 14A are similar to the previously described outer housing 12 and plug member 14, similar parts appearing in FIGS. 13–15 and FIGS. 5, 8 and 6, respectively, are represented by the same, corresponding reference numeral, except for the suffix "A" and the numerals of the latter.

Outer housing 12A (FIGS. 13 and 14) is provided with three slots 60A spaced equidistant about the outer housing 12A, and a plug member 14A (FIG. 15) is provided with three tabs 62A spaced equidistant about plug member 14A. The location and number of slots 60A with respect to the location and number of tabs 62A requires a maximum of 120° of rotation of the plug member 14A with respect to the outer housing 12A to align tabs 62A with slots 60A. The outer housing 12A is further provided with three undercut sections 26A spaced equidistant about outer housing 12A. The location of undercut sections 26A with respect to slots 60A requires a minimum of 60° of rotation of plug member 14A with respect to outer housing 12A between the insertion of position and the locked position of plug member 14A with respect to outer housing 12A. It should be noted that while embodiments of the invention have been described to include two or three corresponding slot/tab/undercut arrangements, arrangements including any member of slots, tabs and undercuts may be incorporated and that these components may be placed at any angular orientation.

Fire wall 76 of outer electrode 72 is in thermal and electrical contact with inner wall 20 of outer housing 12 when plug member 14 is locked within outer housing 12 and lower end 34 of axial electrode 28 is located within combustion area 36 of the internal combustion engine. A spark gap 80 is formed between lower end 34 of axial electrode 28 and tab 74 of outer electrode 72 when plug member 14 is locked within outer housing 12. Fire wall 76 is compressed within groove 78 of insulator element 30, thereby allowing for easy insertion and installation of plug member 14 within outer housing 12 of spark plug 10. Fire wall 76 acts as a heat sink by transferring the heat collected by outer electrode 72, insulator element 30 and axial electrode 28 to inner wall 20 of outer housing 12 and cylinder head 48. In addition, fire wall 76 isolates those portions of spark plug 10 that are above fire wall 76 of outer electrode 72 from the combustion area or combustion chamber 36. Further, in a conventional plug (i.e., a plug without a fire wall 76), the heat range of the spark plug is primarily a function of the length of the nose of the plug. The propagation of heat throughout outer housing 12, and thus spark plug 10, may be regulated and/or varied by changing the location of fire wall 76 along the length of insulator element 30. More specifically, moving fire wall 76 along the length of insulator element 30 changes the overall path of heat dissipation. The greater the distance between the location at which fire wall 76 contacts inner wall 20 of outer housing 12 the slower the rate of heat dissipation, therefore, the greater the temperature of the plug.

An advantage of fire wall 76 is that the heat transfer characteristics of the plug, or heat range, or may be adjusted by changing the location of the fire wall 76 along the length of insulator element 30. Fine tuning of the heat range of spark plug 10 assists in avoiding following of electrodes 28 and 72, as well as pre-ignition problems.

Another advantage of fire wall 76 is that the heat seal created between fire wall 76 and outer housing 12 assists in isolating those portions of spark plug 10 located above firewall 76 from the heat generated within combustion chamber 36, thereby decreasing heat damage and corrosion to those components such as seals 68 and 70.

A further advantage of fire wall 76 is that the volume of the combustion chamber may be regulated and/or varied by changing the location of fire wall 76 along the length of insulator element 30, thereby allowing for the fine tuning of the volume of the combustion chamber. This fine tuning allows adjustment resulting in greater fuel efficiency for greater gas mileage, and a reduction of pollutants such as nitrogen oxides and CFCs.

Figure 10:
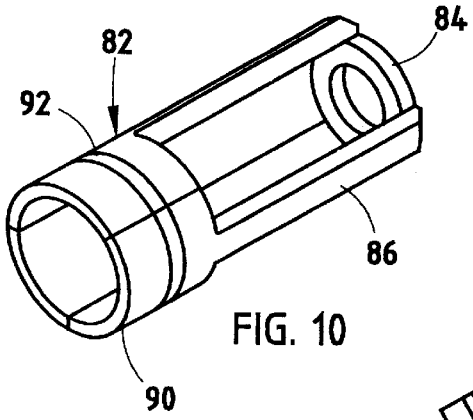
FIG. 10 is a perspective view of a ring-shaped electrode and an associated fire wall.
Figure 11:
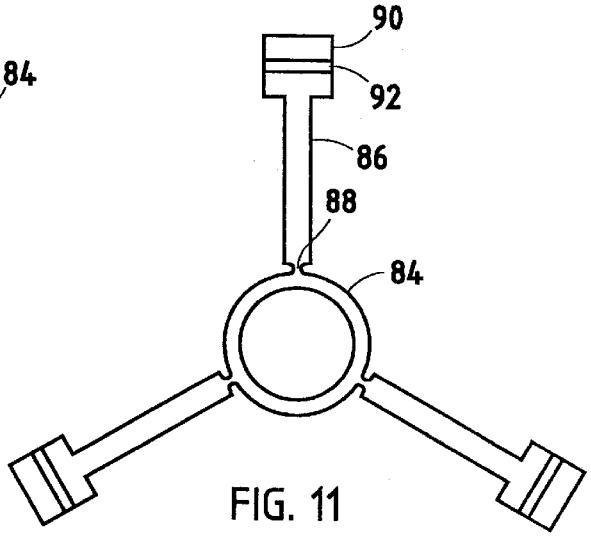
FIG. 11 is a bottom plan view of a ring-shaped electrode and an associated fire wall in a planar orientation.
Figure 12:
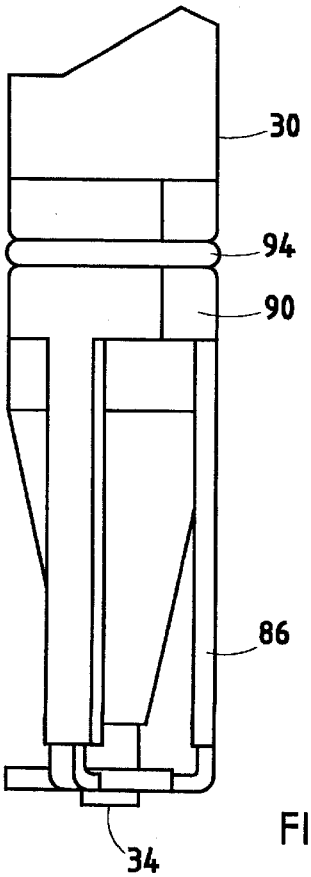
FIG. 12 is a front elevational view of a center electrode with the ring-shaped electrode positioned thereabout.
Figure 13:
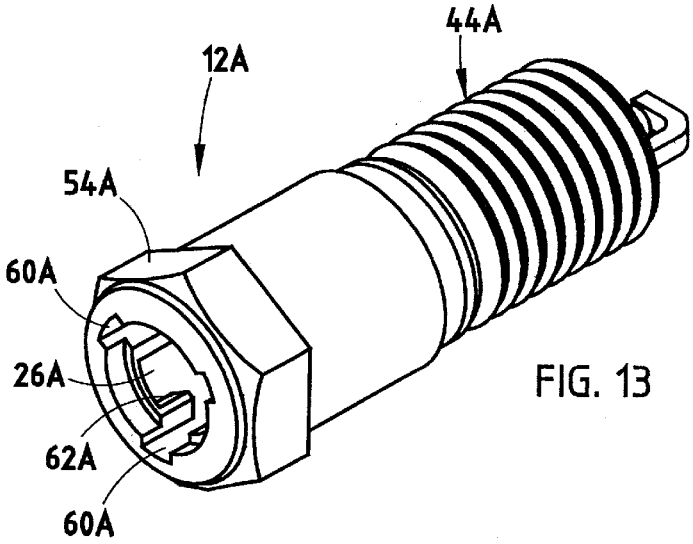
FIG. 13 is a perspective view of the outer member adapted to receive a three prong plug member.
Figure 14:
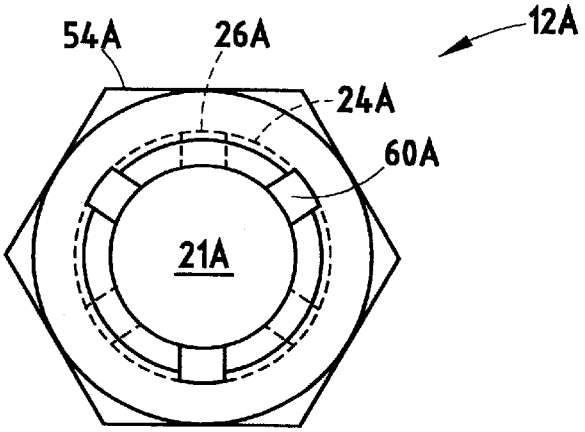
FIG. 14 is a top plan view of the outer member adapted to receive the three prong plug member, with undercut notches shown in dashed lines.
Figure 15:
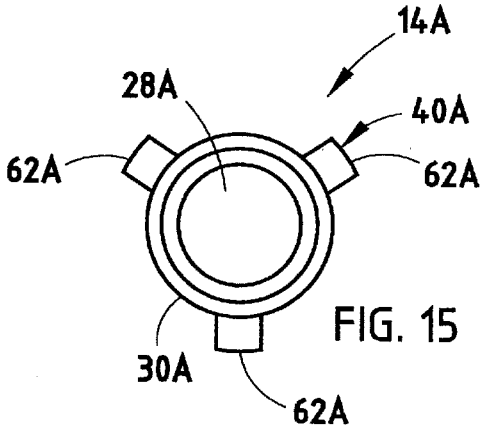
FIG. 15 is a top plan view of the three prong plug member.

In an alternative embodiment, spark plug 10 is provided with a ring-type outer electrode 82 (FIGS. 10–12). Outer electrode 82 is provided with a ring-shaped electrode 84, three supporting legs each bendably connected with ring-shaped electrode 84 at a point 88 and spaced equidistant about the outer circumference of ring-shaped electrode 84, and three fire walls 90 each connected to a radial end of a corresponding support leg 86. Each fire wall 90 is provided with a centrally located laterally extending channel 92 adapted for receiving a fire wall retainer ring 94 therein, as discussed below. Alternatively, fire walls 90 can be provided as a single piece attached to ring-shaped electrode 84 by way of a single supporting leg 86. Prior to assembly, outer electrode 82 is provided in a planar condition (FIG. 11) with ring-shaped electrode 84, supporting legs 86, and fire walls 90 lying in a single plane. In assembly, supporting legs 86 are pivoted about ring-shaped electrode 84 at the corresponding bending points 88 and fire walls 90 are compressed within groove 78 of insulator element 30, thereby completely encompassing groove 78 of insulator element 30 and isolating those portions of spark plug 10 above fire walls 90 from combustion chamber 36. Fire wall retaining ring 94 is placed within channel 92 of each fire wall 90, thereby retaining each fire wall 90 within channel 78 of insulator element 30.

Figure 16:
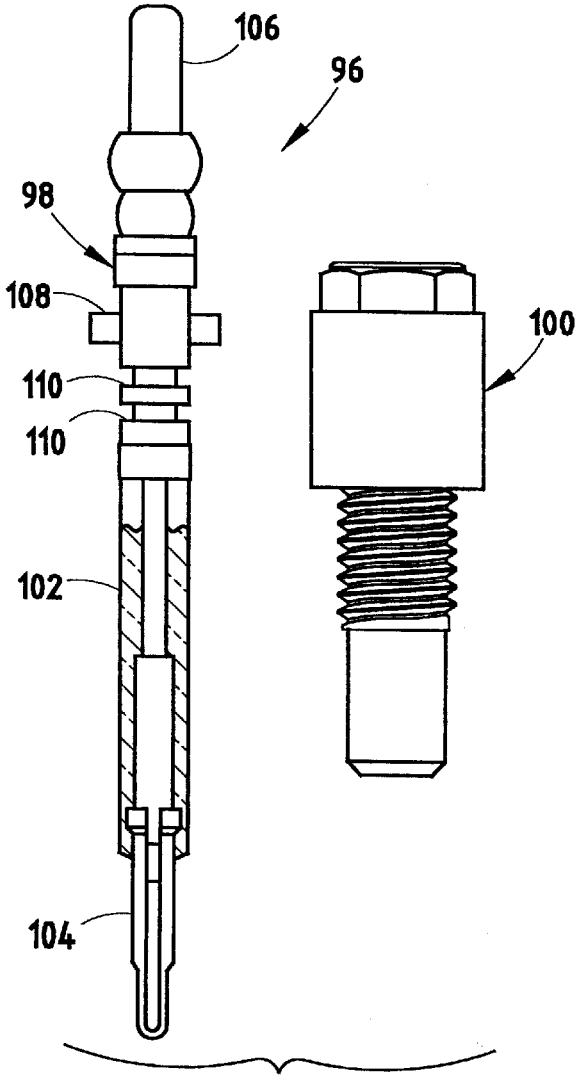
FIG. 16 is a front elevational view of the glow plug, with a plug member partially cut away.

Although the quick connect assembly has been explained in connection with a spark plug for use within internal combustion engines, the quick connect assembly of spark plug 10 may also be applied to a glow plug 96 for use within diesel engines, as shown in FIG. 16. Similar to spark plug 10 (FIG. 1) glow plug 96 includes a plug member 98 and a body member or outer housing 100. Plug member 98 is provided with a ceramic insulator element 102, a heating element 104 and an electrical terminal 106. Ceramic insulator 102 is provided with two outwardly radially extending tabs 108, and two circumferential annular grooves 110. Preferably, a high tensile strength, fiber reinforced ceramic is used for insulator element 102, such as that described above in relation to spark plug 10. A pair of seals (not shown), such as a pair of o-rings, may be placed within the grooves 110, thereby providing a seal between the combustion chamber of the associated diesel engine and those portions of the glow plug 96 located above the o-rings or seal. Grooves 110 and the associated seals may be replaced with other suitable seal arrangements adequate to prevent a pressure generated within the combustion chamber of the diesel engine from escaping through glow plug 96.

Outer housing 100 of glow plug 96 is similar in construction to outer housing 12 of spark plug 10. More specifically, outer housing 100 is provided with multiple profiles, longitudinally extending channels and undercut sections that are similar to those components associated with outer housing 12 of spark plug 10. In assembly, plug member 98 of glow plug 96 is assembled and disassembled with outer housing 100 of glow plug 96 similar to spark plug 10.

Figure 17:
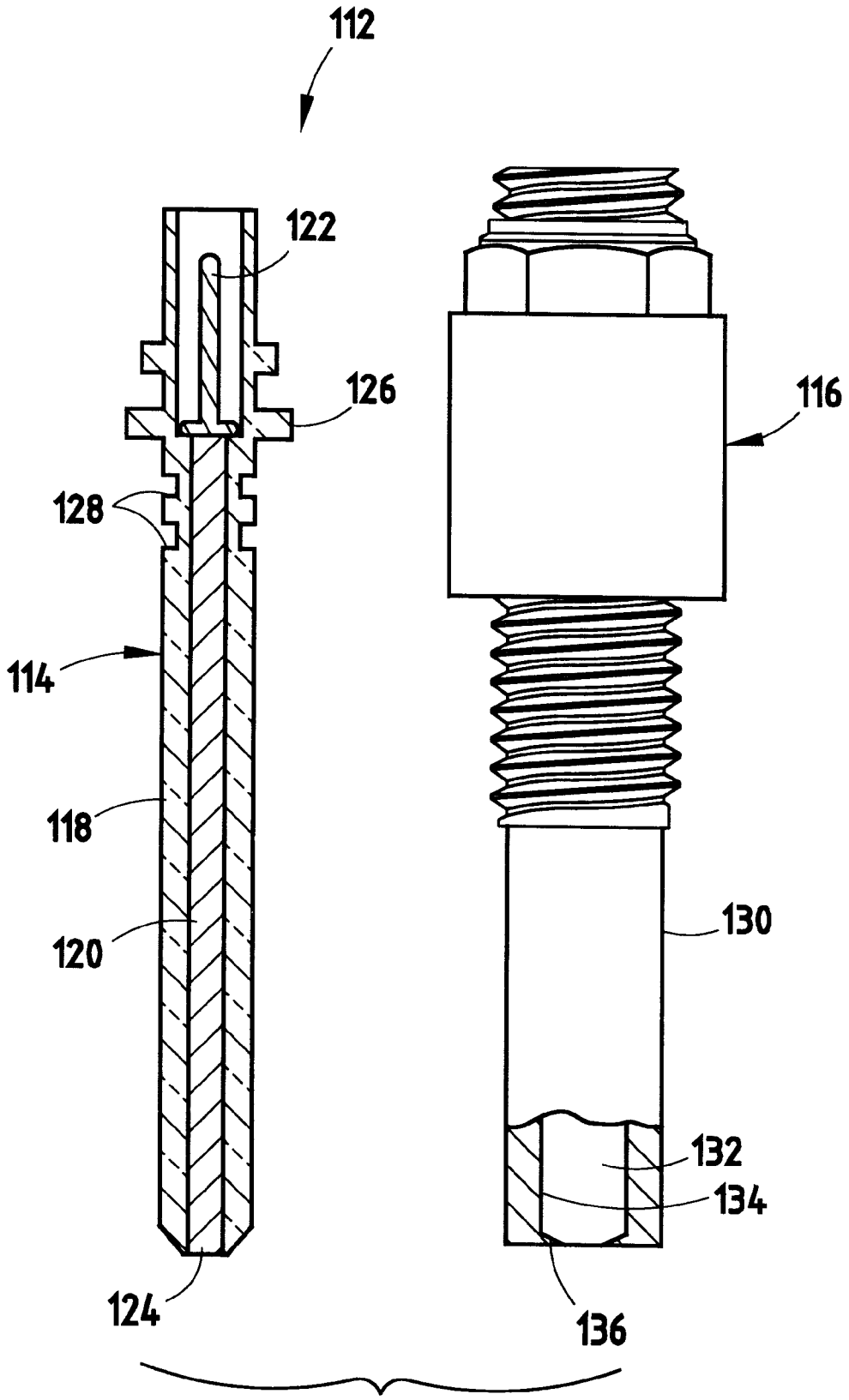
FIG. 17 is a front elevational view of a gas turbine igniter, with an igniter member shown in cross-section along its longitudinal axis, and housing member partially cut away.
Figure 18:
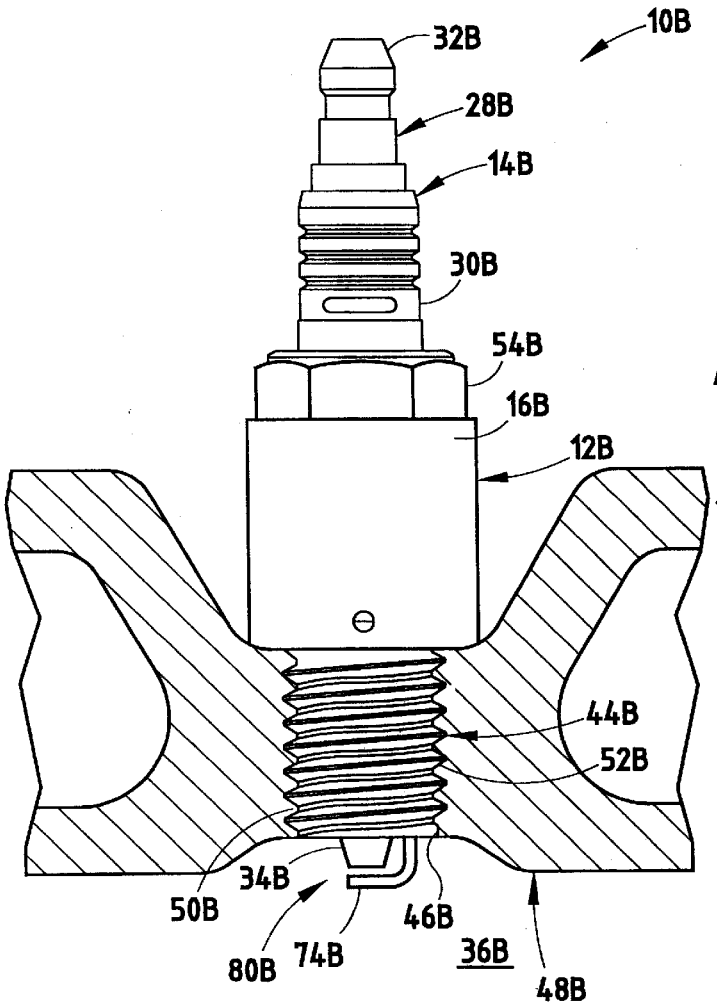
FIG. 18 is a front elevational view of a first alternative embodiment of the spark plug of the present invention within a cylinder head of an internal combustion engine.
Figure 19:
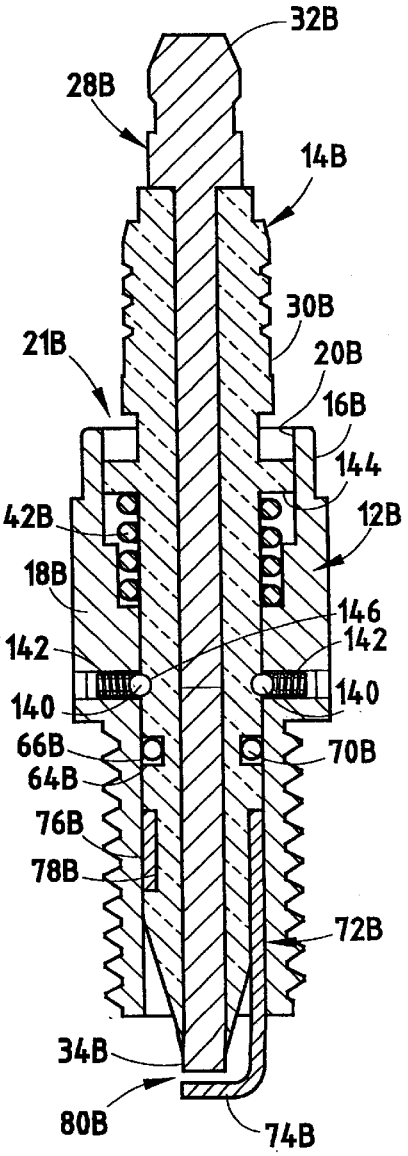
FIG. 19 is a cross-sectional view of the first alternative embodiment of the spark plug along its longitudinal axis.
Figure 20:
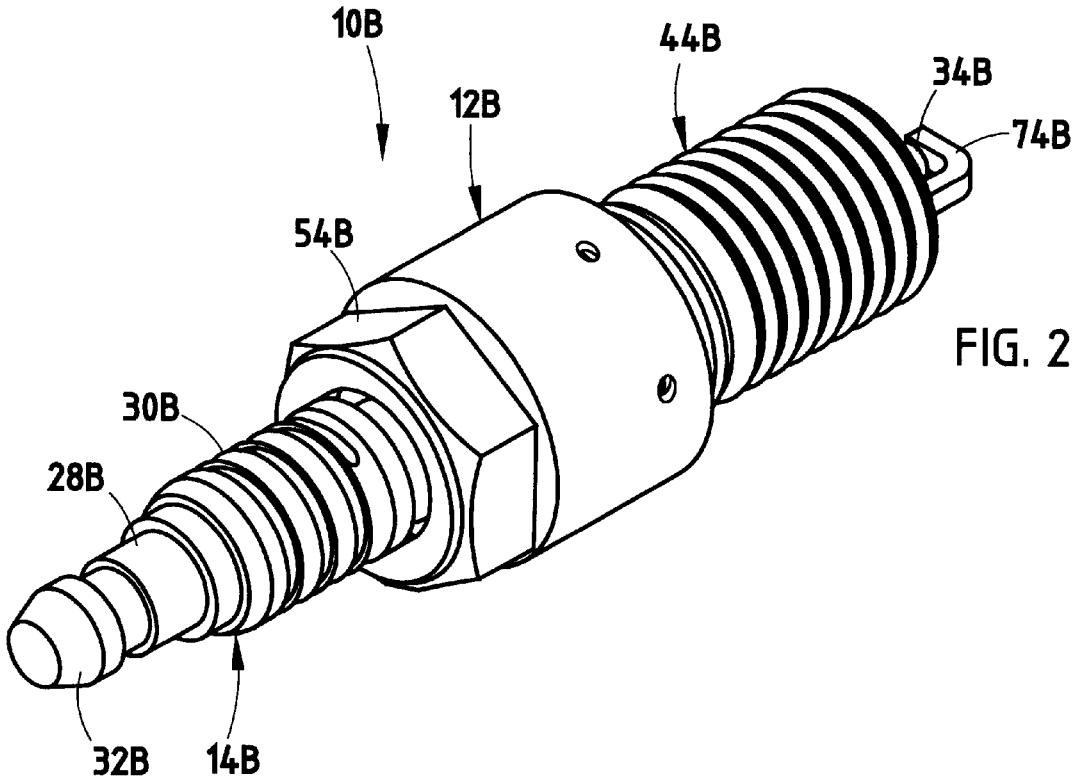
FIG. 20 is a perspective view of the first alternative embodiment of the spark plug.
Figure 21:
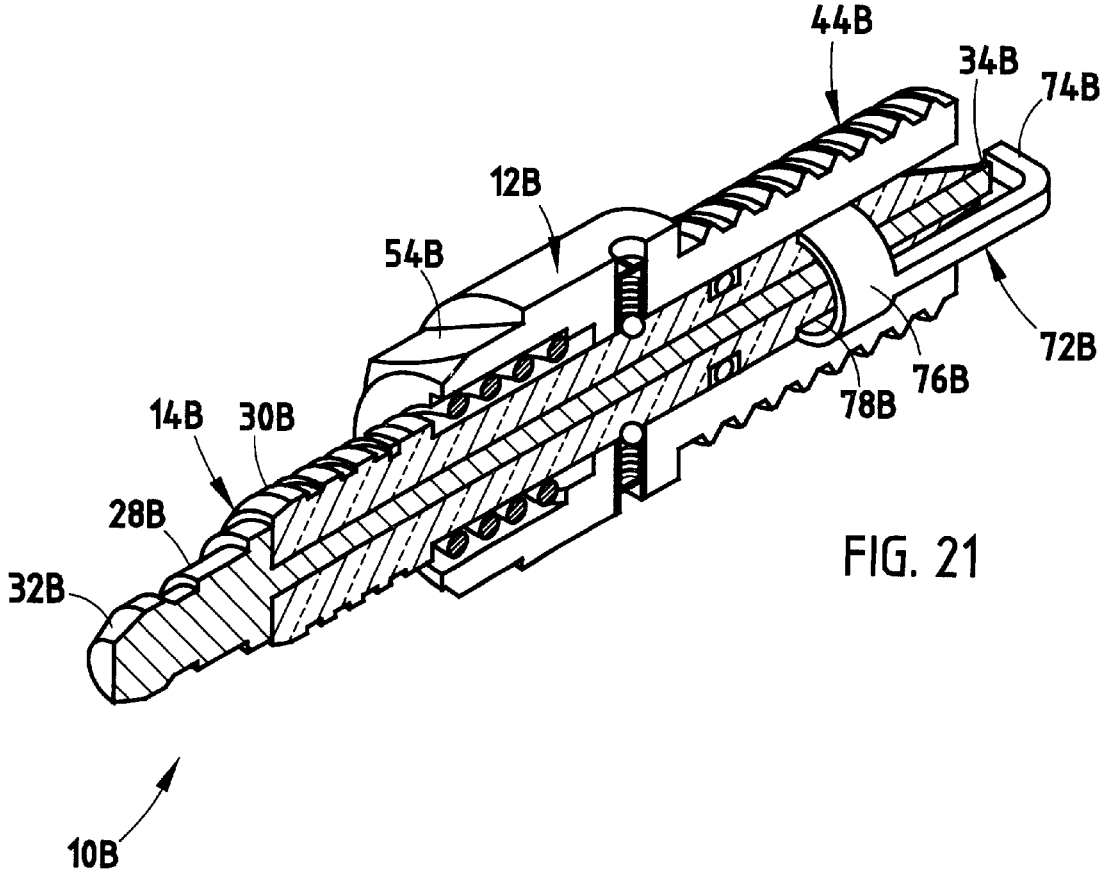
FIG. 21 is a cross-sectional perspective view of the first alternative embodiment of the spark plug along its longitudinal axis.

In another application of the quick connect assembly of the present invention, the quick connect assembly is used within a gas turbine igniter 112 (FIG. 17) such as that used in conjunction with gas turbine engines. Gas turbine igniter 112 is provided with a cylindrical igniter member 114 and a cylindrical body member or outer housing 116. Igniter member 114 is provided with a ceramic insulator element 118 and axially extending inner electrode 120 having a proximal end 122 adapted for connection with an electrical supply and a distal end 124. Preferably, a high tensile strength, fiber reinforced ceramic is used for insulator 118, such as that described above in relation to spark plug 10. Insulator element 118 is provided with a pair of radially outwardly extending tabs 126 and a pair of circumferential annular grooves 128. Grooves 128 are adapted to receive a pair of seals (not shown) therein, thereby preventing the pressure generated within the combustion area of the associated gas turbine engine from escaping through gas turbine igniter 112. Grooves 128 and the associated seals may be replaced with other suitable arrangements adequate to prevent the pressure generated within the combustion area from escaping from gas turbine igniter 112.

Outer housing 116 of gas turbine igniter 112 is provided with multiple profiles, longitudinally extending channels and undercut sections that are similar to those components associated with outer housing 12 of spark plug 10 (FIG. 1). Outer housing 116 is further provided with a metal housing section 130 having an internal passage 132 defining an inner wall 134 and distally located outer electrodes 136.

It should be noted that various orientations, numbers and spacing of the slots, tabs and undercut sections associated with glow plug 96 and gas turbine igniter 112 may be used similar to those described above with respect to spark plug 10.

In assembly, igniter member 112 of gas turbine igniter 112 is assembled and disassembled with outer housing 116 of gas turbine igniter 112 similar to spark plug 10. Further, igniter member 114 is located within outer housing 116 such that distal end 124 of inner electrode 120 is in close proximately to outer electrodes 136 of metal housing section 130, thereby allowing a spark to be generated between distal end 124 of inner electrode 120 and outer electrode 136 of metal housing section 130.

The reference numeral 10B generally designates a two-piece spark plug that includes a first alternative embodiment of the present invention. Since the spark plug 10B is similar to the previously described spark plug 10, similar parts appearing in FIGS. 16–21 and FIGS. 1–5 and 6, respectively, are represented by the same, corresponding reference numeral, except for the suffix "B" and the numerals of the latter.

The reference to numeral 10B (FIG. 18) generally designates a two-piece, quick release spark plug embodying a first alternative of the present invention. Spark plug 10B includes a cylindrical body member or outer housing 12B and a cylindrical plug member 14B. The outer housing 12B (FIG. 19) includes a cylindrical member 16B that has an outer wall 18B and an inner wall 20B. The inner wall 20B defines a passage 21B through outer housing 12B. The outer housing 12B further includes a pair of engagement members 140 in the form of ball bearings that are inwardly biased to partially extend within passage 21B by a pair of biasing members 142 in the form of coil springs. Although the illustrated outer housing 12B includes ball bearings as engagement members 140, it should be noted that other forms of engagement members could be used such as, but not limited to, pins and dogs. Outer housing 12B is similar in construction to outer housing 12, and may be connected to the associated cylinder head 48B in a similar manner.

The plug member 14B is adapted to fit within passage 21B of outer housing 12B and includes an axial electrode 28B and an electrically insulating insulator element 30B encircling axial electrode 28B. The axial electrode 28B has a first end 32B for connection to an electric source, and a second end 34B for engagement within a combustion area 361. Insulator element 30B is similar in construction to insulator 30 described above. The plug number 14 has a circumferential annular biasing wall 144. The plug member also includes a circumferential annular groove 146 adapted to receive the engagement members therein. Plug member 14B is further provided with a sealing groove 64B and an associated sealing ring 68B similar to plug member 14. Plug member 14B also includes an outer electrode or ground electrode similar to plug member 14.

The spark plug 10 further includes a longitudinally extending biasing member 42B in the form of a coil spring positioned about plug member 14B. The biasing member may be coupled with either the outer housing 12B or the plug member 14B.

The plug member 14B (FIGS. 18–21) is releasably coupled with outer housing 12B by inserting plug member 14B within passage 21B of outer housing 12B and exerting an axial force on plug member 14B until engagement members 140 are allowed to engage within groove 146 of plug member 14B. Biasing members 142 bias the engagement members into engagement within groove 145, thereby releasably locking the plug member 14B within the outer housing 12B.

To remove and replace plug member 14B, an axial force is exerted on plug member 14B, thereby compressing biasing member 42B and moving engagement members 140 beyond the point of engagement. The axial force is then quickly released from plug member 14B, and the force exerted on plug member 14B by biasing member 42B in combination with the momentum of the plug member 14B, carries plug member 14B part of the point of engagement, thereby allowing the removal of the plug member 14B from within outer housing 12B.

Figure 22:
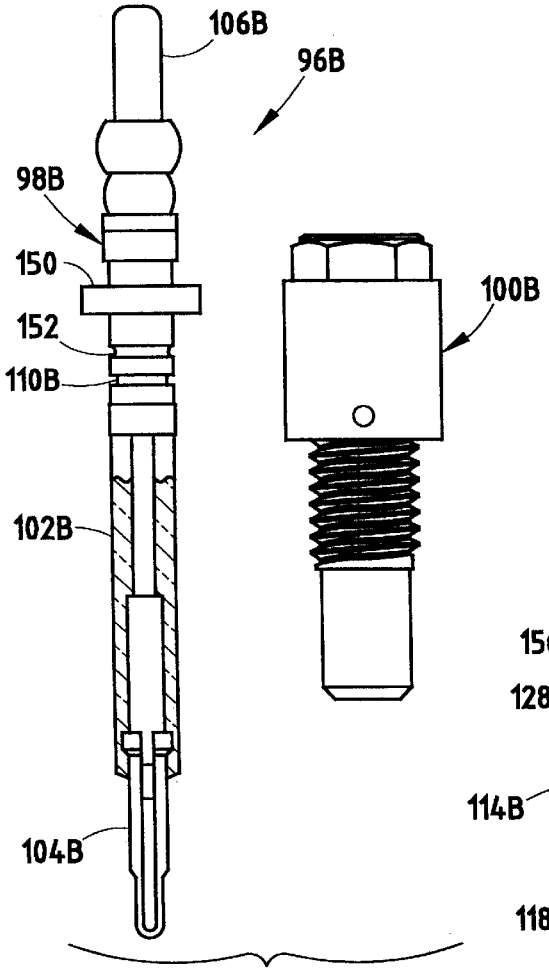
FIG. 22 is a front elevational view of a first alternative embodiment of the glow plug with the first alternative embodiment of the present invention.

Although the first alternative embodiment of the quick connect assembly has been explained in connection with a spark plug for use within internal combustion engines, the quick connect assembly of spark plug 10B may also be applied to a glow plug 96B for use within diesel engines, as shown in FIG. 22. Similar to spark plug 10B (FIG. 18), glow plug 96B includes a plug member 98B and a body member or outer housing 100B. Plug member 98B is provided with a ceramic insulator element 102B, a heating element 104B and an electrical terminal 106B. Ceramic insulator 102B is provided with a circumferential annular biasing wall 150, and a circumferential annular groove 152. Preferably, a high tensile strength, fiber reinforced ceramic is used for insulator element 102B, such as that described above in relation to spark plug 10. A seal (not shown), such as an o-ring, may be placed within groove 1103B, thereby providing a seal between the combustion chamber of the associated diesel engine and those portions of the glow plug 96B located above o-ring or seal. Groove 110B and the associated seal may be replaced with other suitable seal arrangements adequate to prevent a pressure generated within the combustion chamber of the diesel engine from escaping through glow plug 96B.

Outer housing 100B of glow plug 96B is similar in construction to outer housing 12B of spark plug 10B. More specifically, outer housing 100B includes at least one engagement member and at least one biasing member located to bias the engagement members. In assembly, plug member 98B of glow plug 96B is assembled and disassembled with outer housing 100B of glow plug 96B similar to spark plug 10B.

Figure 23:
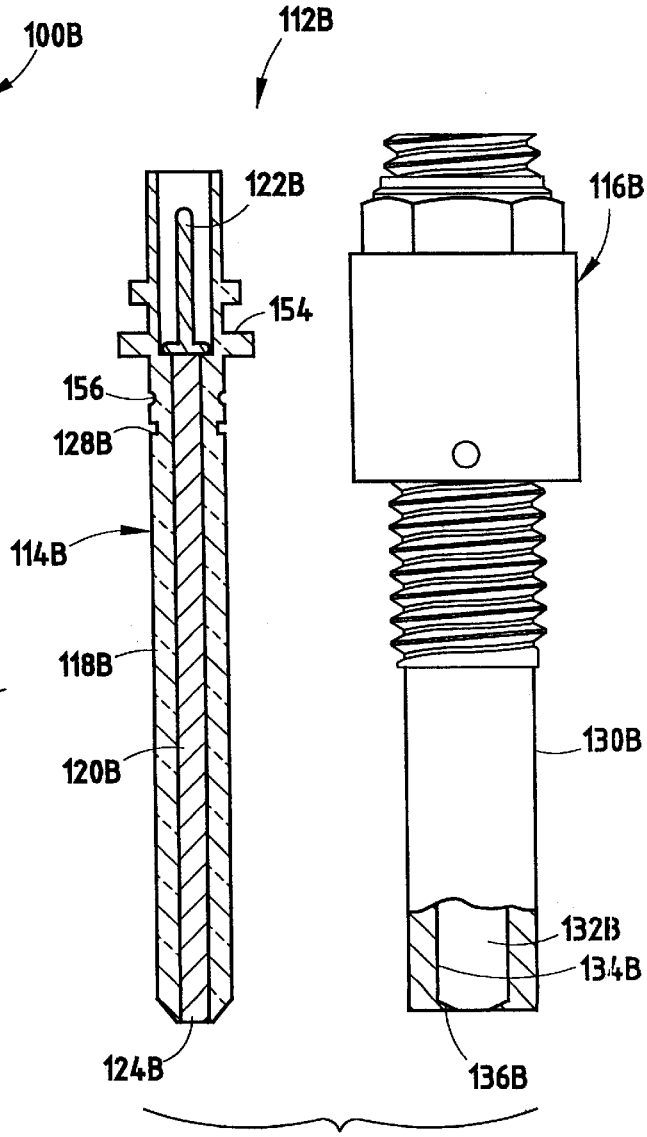
FIG. 23 is a cross-sectional view of the gas turbine igniter with the first alternative embodiment of the present invention.
Figure 24:
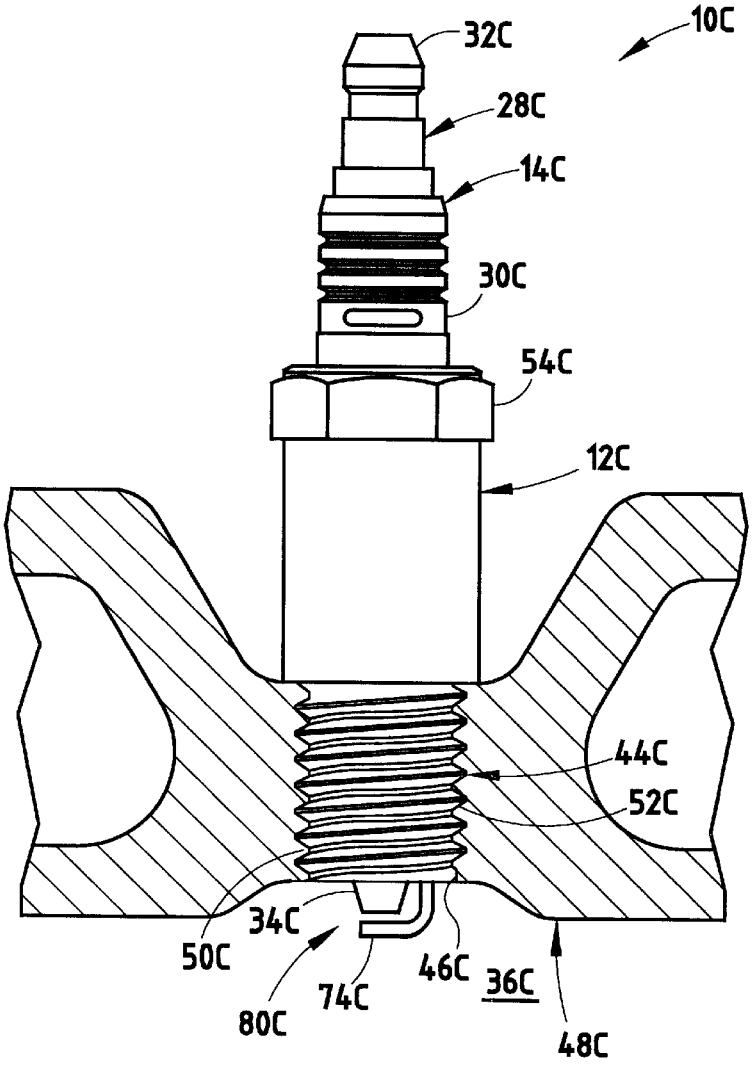
FIG. 24 is a front elevational view of a second alternative embodiment of the spark plug of the present invention within a cylinder head of an internal combustion engine.
Figure 25:
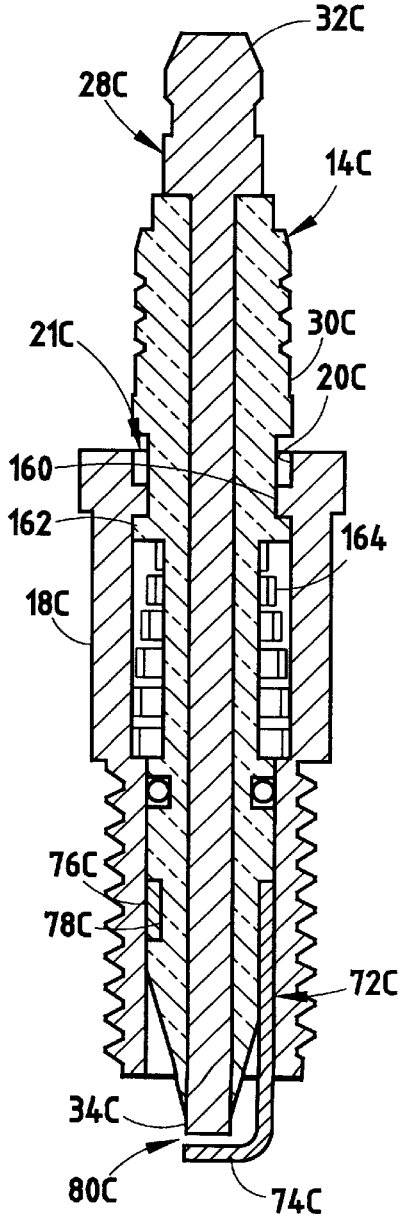
FIG. 25 is a cross-sectional view of the second alternative embodiment of the spark plug along its longitudinal axis.
Figure 26:
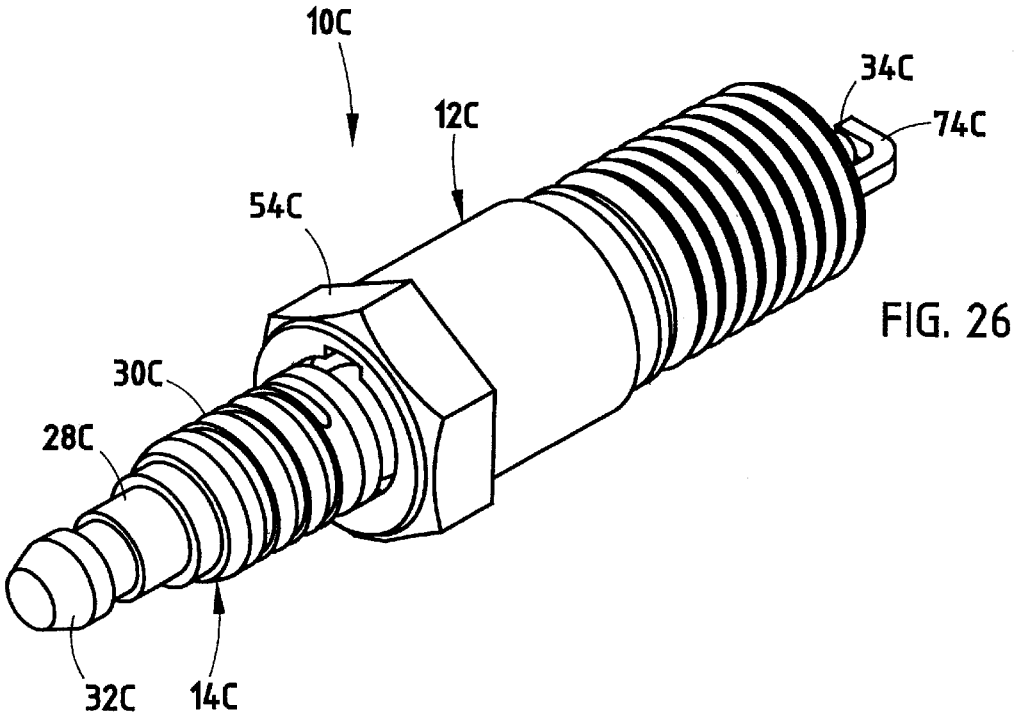
FIG. 26 is a perspective view of the second alternative embodiment of the spark plug.
Figure 27:
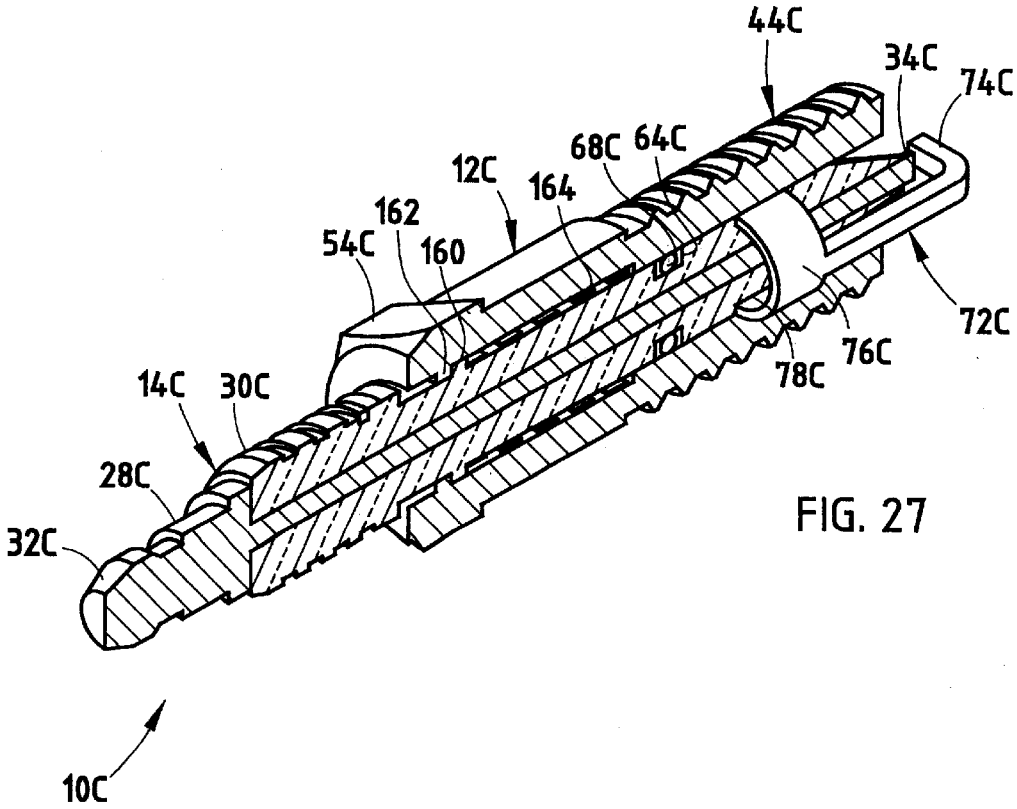
FIG. 27 is a cross-sectional perspective view of the second alternative embodiment of the spark plug along its longitudinal axis.

In another application of the quick connect assembly of the present invention, the quick connect assembly is used within a gas turbine igniter 112B (FIG. 23) such as that used in conjunction with gas turbine engines. Gas turbine igniter 112B is provided with a cylindrical igniter member 114B and a cylindrical body member or outer housing 116B. Igniter member 114B is provided with a ceramic insulator element 118B and axially extending inner electrode 120B having a proximal end 122B adapted for connection with an electrical supply and a distal end 124B. Preferably, a high tensile strength, fiber reinforced ceramic is used for insulator 118B, such as that described above in relation to spark plug 10. Insulator element 118B is provided with a circumferential annular biasing wall 154 and a circumferential annular groove 156. Insulator element 118B further includes a circumferential annular groove 128B. Groove 128B is adapted to receive a seal (not shown) therein, thereby preventing the pressure generated within the combustion area of the associated gas turbine engine from escaping through gas turbine igniter 112B. Groove 128B and the associated seal may be replaced with other suitable arrangements adequate to prevent the pressure generated within the combustion area from escaping from gas turbine igniter 112B.

Outer housing 116B of gas turbine igniter 112B is constructed similarly to outer housing 12B of spark plug 10B, and includes at least one engagement member and at least one biasing member located to bias the engagement member. Outer housing 116B is further provided with a metal housing section 130B having an internal passage 132B defining an inner wall 134B and distally located outer electrodes 136B.

In assembly, igniter member 114B of gas turbine igniter 112B is assembled and disassembled with outer housing 116B of gas turbine igniter 112B similar to spark plug 10B. Further, igniter member 114B is located within outer housing 116B such that distal end 124B of inner electrode 120B is in close proximity to outer electrodes 136B of metal housing section 130B, thereby allowing a spark to be generated between distal end 124B of inner electrode 120B and outer electrode 136B of metal housing section 130B.

The reference numeral 10C generally designates another embodiment of the present invitation. Since the spark plug 10C is similar to the previously described spark plug 10A, similar parts appearing in FIGS. 24–27 and FIGS. 1–4 respectively, are represented by the same, corresponding reference numeral, except for the suffix "C" in the numerals of the latter.

The reference numeral 10C (FIG. 24) generally designates a second alternative two-piece, quick release spark plug that includes a second alternative embodiment of the present invention. Spark plug 10C includes a cylindrical body member or outer housing 12C and a cylindrical plug member 14C. The outer housing 12C (FIG. 25) includes a cylindrical member 16C that has an outer wall 18C and an inner wall 20C. The inner wall 20C defines a passage 21C through outer housing 12C. The inner wall 20C is provided with a plurality of inwardly extending projections 16C spaced equidistant about outer housing 12C. Outer housing 12C is similar in construction to outer housing 12, and may be connected to the associated cylinder 48B in a similar manner.

The plug member 14C is adapted to fit within passage 21C of outer housing 12C and includes an axial electrode 28C and an electrically insulating insulator element 30C encircling axial electrode 28C. The axial electrode 28C has a first end 32C for connection to an electric source, and a second end 345C for engagement within a combustion area 36C. Insulator element 30C is similar in construction to insulator 30 described above. The plug member 14C is provided with a plurality of outwardly extending projections 162 spaced equidistant about plug member 14C. The projections 162 of plug member 14C are adapted to engage with projections 160 of outer housing 12C. Plug member 14B is further provided with a sealing groove 64B and an associated sealing ring 68B similar to plug member 14. Plug member 14B also includes an outer electrode or ground electrode similar to plug member 14.

The spark plug 10C further includes a longitudinally extending biasing member 164 positioned about plug member 14 that provides both an axial and rotational force on plug member 14C as the biasing member 164 is compressed. As illustrated, biasing member 164 is a conical helical spring, however, other spring geometries that exert an axial force and a rotational force when compressed may be employed such as cylindrically shaped springs, and "hourglass" shaped springs. In addition, types of springs may be used such as a cylindrically shaped coil springs.

Figure 28:
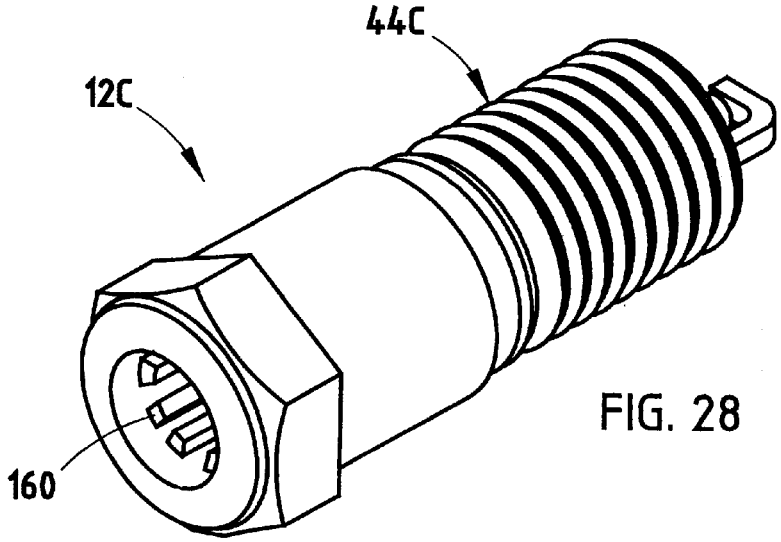
FIG. 28 is a perspective view of an outer housing of the second alternative embodiment.
Figure 29:
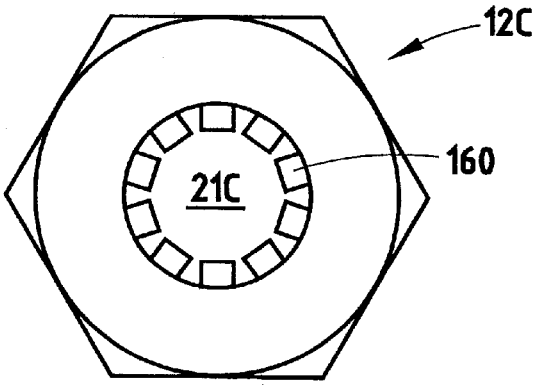
FIG. 29 is a top plan view of the outer housing of the second alternative embodiment.
Figure 30:
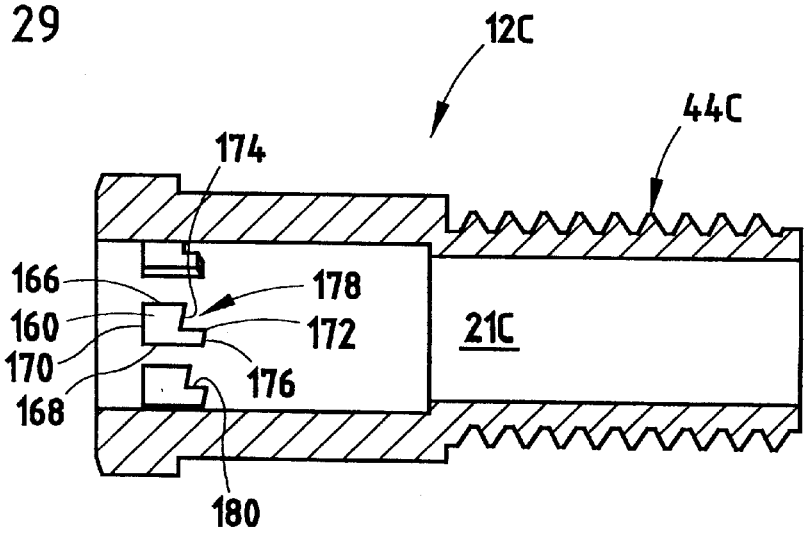
FIG. 30 is a cross sectional view of the outer housing of the second alternative embodiment along its longitudinal axis.

The plurality of inwardly extending projections 160 (FIGS. 28–30) of outer housing 12C are spaced equidistant about outer housing 12C. Each projection 160 is defined by a first side wall 166, a second side wall 168, a top wall 170, and a bottom wall 172. Bottom wall 172 includes a first angled section 174 and a second angled section 176 that cooperate to form a notch 178 and a notch wall 180.

Figure 31A:
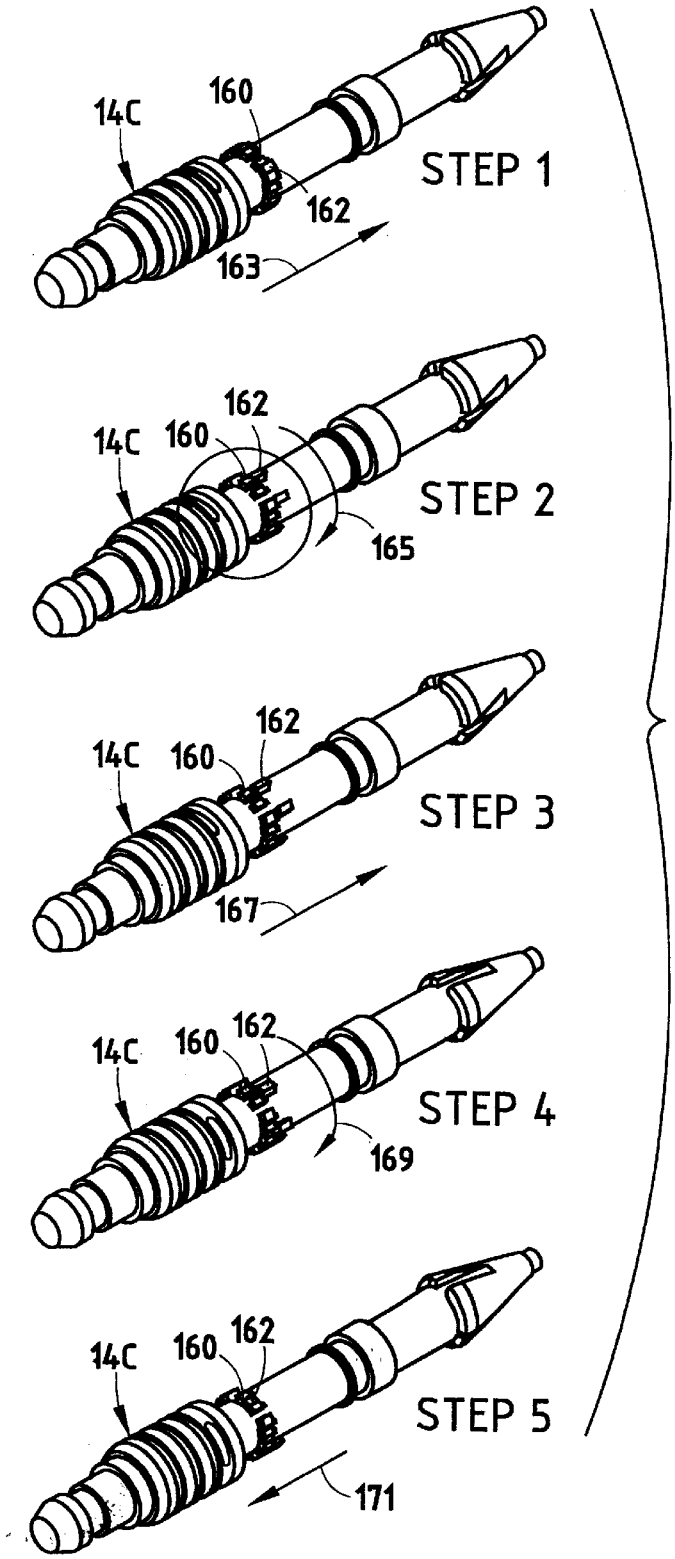
FIG. 31A is a perspective view of a plug member of the second embodiment of the spark plug, with the operation of the plug member shown as successive steps.
Figure 31B:
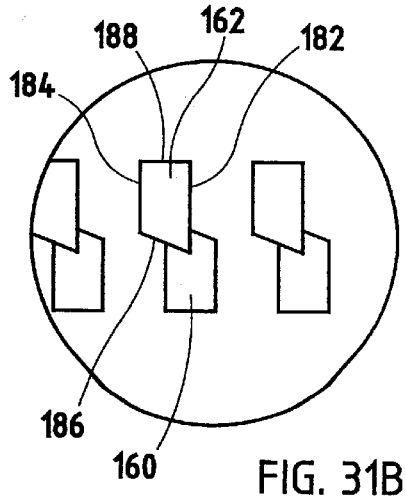
FIG. 31B is an enlarged view of a plurality of first projections of the outer member engaged with a plurality of second projections of the plug member.
Figure 32:
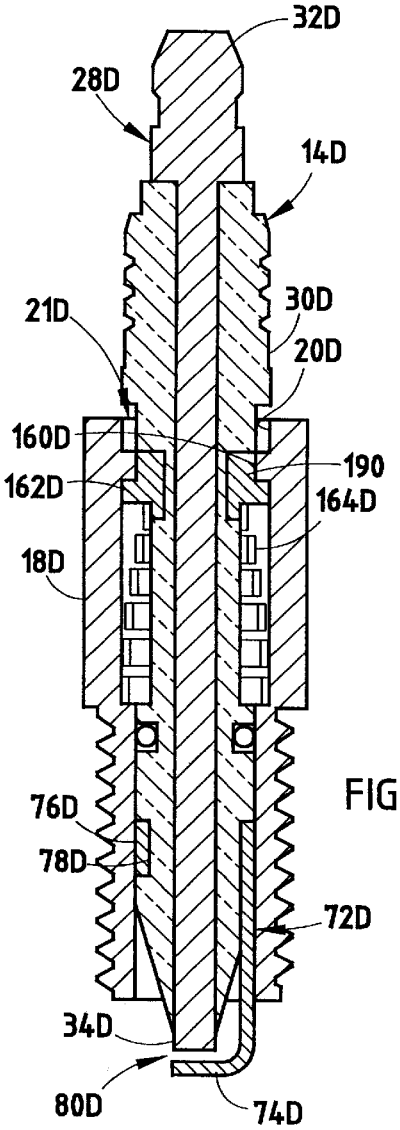
FIG. 32 is a cross-sectional view of the second embodiment of the spark plug with a locking ring.
Figure 33:
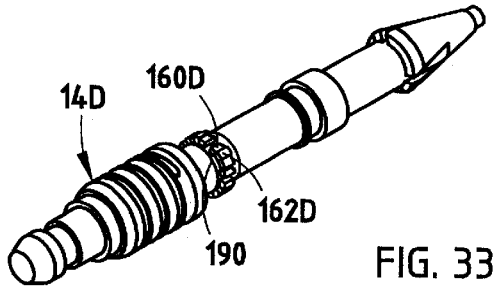
FIG. 33 is a perspective view of the second embodiment of the plug member with the locking ring.
Figure 34:
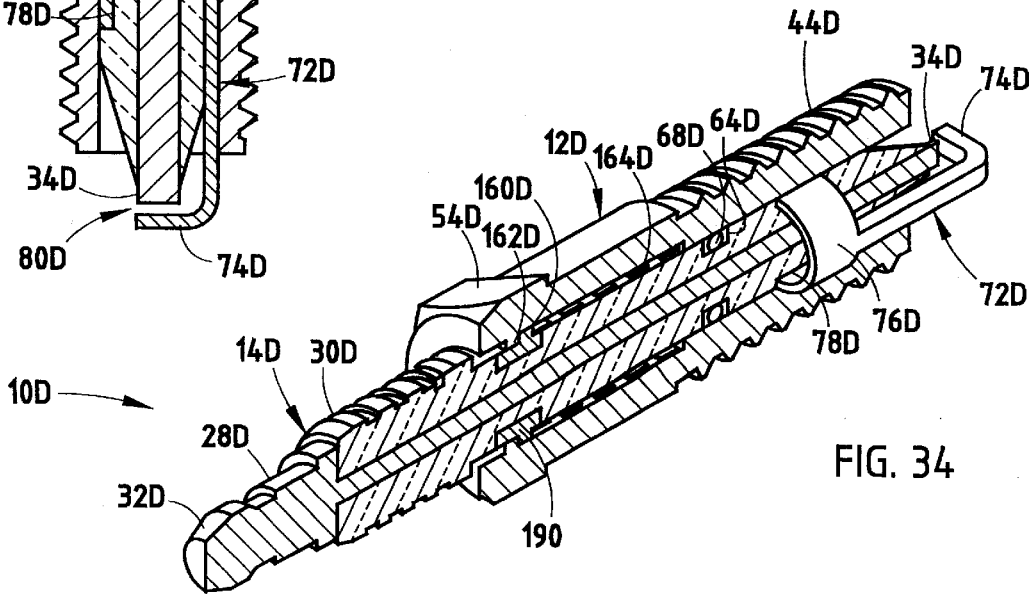
FIG. 34 is a cross-sectional perspective view of the second embodiment of the spark plug with the locking ring.

The plurality of outwardly extending projections 162 (FIG. 31A) of plug member 14C are spaced equidistant about plug member 14C. Spark plug 10C preferably includes one less projection 162 of plug member 14C than there are projections 160 of outer housing 160, however, numerous arrangements and combinations of projections may be employed. Each projection 162 (FIG. 31B) of plug member 14C is defined by a first side wall 182, a second side wall 184, a top wall 186, and a bottom wall 188. The top wall 186 of each projection 162 is angled similarly to first section 174 and second section 176 of bottom wall 172 of outer housing 12C.

In assembly, plug member 14C (FIGS. 24–27 and 31A) is inserted within outer housing 12C by aligning projections 162 of plug member 14C such that they fall between projections 160 of outer housing 12C (Step 1). An axial load, in a direction indicated by arrow 163, is then placed on plug member 14C, thereby forcing biasing member 164 to compress and exert an oppositely directed axial load and a rotational force on plug member 14C. The axial force inserting plug member 14C into outer housing 12C is increased until top wall 186 of each projection 162 of plug member 14C is inserted beyond bottom wall 172 of each projection 160 of outer housing 12C (Step 2). Once top wall 186 of each projection 162 of each plug member 14C has "cleared" bottom wall 172 of each projection 160 of outer housing 12C, the rotational force, in a direction indicated by arrow 165, being exerted on plug member 14C by biasing member 164 causes plug member 14C to rotate with respect to outer housing 12C and projections 162 to at least partially align with the notches 178 of projections 160. Notch wall 180 prevents the over-rotation of plug member 14C.

The axial force being exerted to insert plug member 14C into outer housing 12C is then released, and the axial force exerted on plug member 14C by biasing member 164 forces angled top wall 186 of each projection 162 into engagement with angled first section 174 of bottom wall 172 of each projection 160. The angled geometry of top wall 186 and first section 174 causes plug member 14C to rotate and projections 162 of plug member 14C to engage within notches 178 of projections 160 of outer housing 12C. Biasing member 164 holds projections 162 into engagement with projections 160, thereby releasably locking plug member 14C within outer housing 12C.

In disassembly, an axial force, in a direction indicated by arrow 167, is exerted on plug member 14C, thereby compressing biasing member 164. The axial force is increased until top walls 186 of projections 162 of plug member 14C are inserted beyond notch walls 180 of projections 160 of outer housing 12C. Once top walls 186 of projections 162 are inserted beyond notch walls 180 of projections 160, a rotational force, in a direction indicated by arrow 168, being exerted on plug member 14C by biasing member 164 causes plug member 14C to rotate with respect to outer housing 12C and top walls 186 of projections 162 to at least partially align with second section 176 of bottom wall 172 of projections 160 (Step 3). The side walls 166 of projections 160 prevent plug member 14C from over-rotating.

The axial force being exerted to insert plug member 14C within outer housing 12C is then released, and the axial force exerted on plug member 14C by biasing member 164, in a direction indicated by arrow 171, forces the angled top walls 186 of projections 162 to at least partially align with angled second sections 176 of bottom walls 172 of projections 160 (Step 4). The angled geometry of top walls 186 and second sections 176 causes projections 162 to align between projections 160, thereby allowing the removal of plug member 14C from within outer housing 12C (Step 5).

The reference numerals 12D and 14D (FIGS. 32–34) generally designate another embodiment of the outer housing and plug member, respectively, of the present invention. Since outer housing 12D and plug member 14D are similar to the previously described outer housing 12C and plug member 14C, similar parts appearing in FIGS. 32–34 and FIGS. 25, 27 and 31A are represented by the same, corresponding reference numeral, except for the suffix "D" in the numerals of the latter.

Plug member 14D is similar in construction to plug member 14C except that projections 162D are fixedly attached to, or integrally formed with, a locking ring 190 that is located within a groove 192 within plug member 14D and is rotatable thereabout. In assembly, projections 162D of plug member 14D may rotate to align with projections 160D of outer housing 12D as described above in relation to spark plug 10C without requiring the rotation of the axial electrode 28D with respect to the outer housing 12D. Similarly, plug member 14D may be disassembled from outer housing 12D without rotating the axial electrode with respect to the outer housing 12D.

Figure 35:
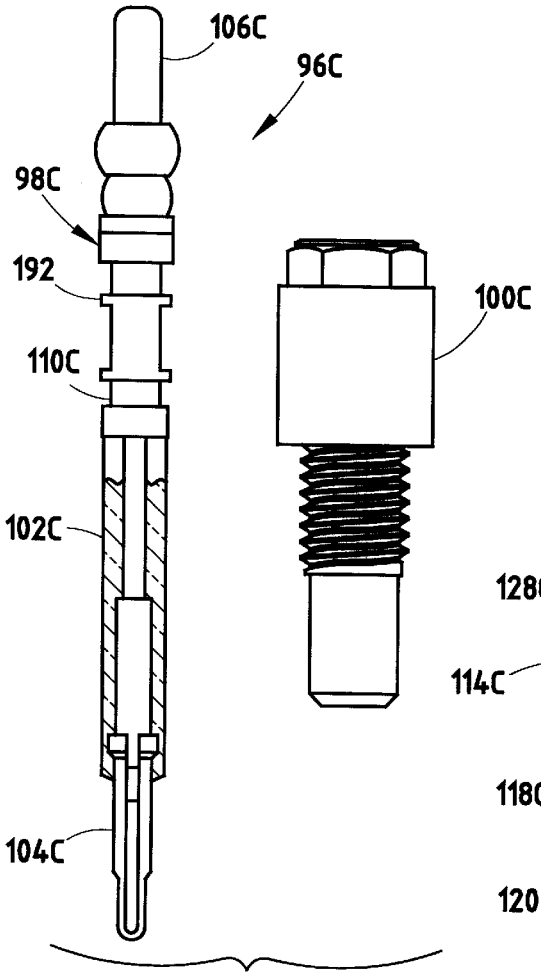
FIG. 35 is a front elevational view of the glow plug with the second alternative embodiment of the present invention and with the plug member partially cut away.

Although the quick connect assembly has been explained in connection with a spark plug for use within internal combustion engines, the quick connect assemblies of spark plug 10C and spark plug 10D may also be applied to a glow plug 96C for use within diesel engines, as shown in FIG. 35. Similar to spark plug 10C (FIG. 24) glow plug 96C includes a plug member 98C and a body member or outer housing 100C. Plug member 98C is provided with a ceramic insulator element 102C, a heating element 104C and an electrical terminal 106C. Ceramic insulator 102C is provided with a circumferentially extending annular groove 110C, and a plurality of outwardly extending projections 192. Preferably, a high tensile strength, fiber reinforced ceramic is used for insulator element 102C, such as that described above in relation to spark plug 10. A seal (not shown), such as an o-ring, may be placed within the groove 110C, thereby providing a seal between the combustion chamber of the associated diesel engine and those portions of the glow plug 96C located above the o-ring or seal. Groove 110C and the associated seal may be replaced with other suitable seal arrangements adequate to prevent a pressure generated within the combustion chamber of the diesel engine from escaping through glow plug 96C. Glow plug 96C also includes a biasing member (not shown) that exerts both an axial and a rotational force on plug member 98C as the biasing member is compressed.

Outer housing 100C of glow plug 96C is similar in construction to outer housing 12C of spark plug 10C. More specifically, outer housing 100C is provided with inwardly extending projections adapted to mateably receive the projections of plug member 98C similar to those components associated with outer housing 12C of spark plug 10C. In assembly, plug member 98C of glow plug 96C is assembled and disassembled with outer housing 100C of glow plug 96C similar to spark plug 10C.

Figure 36:
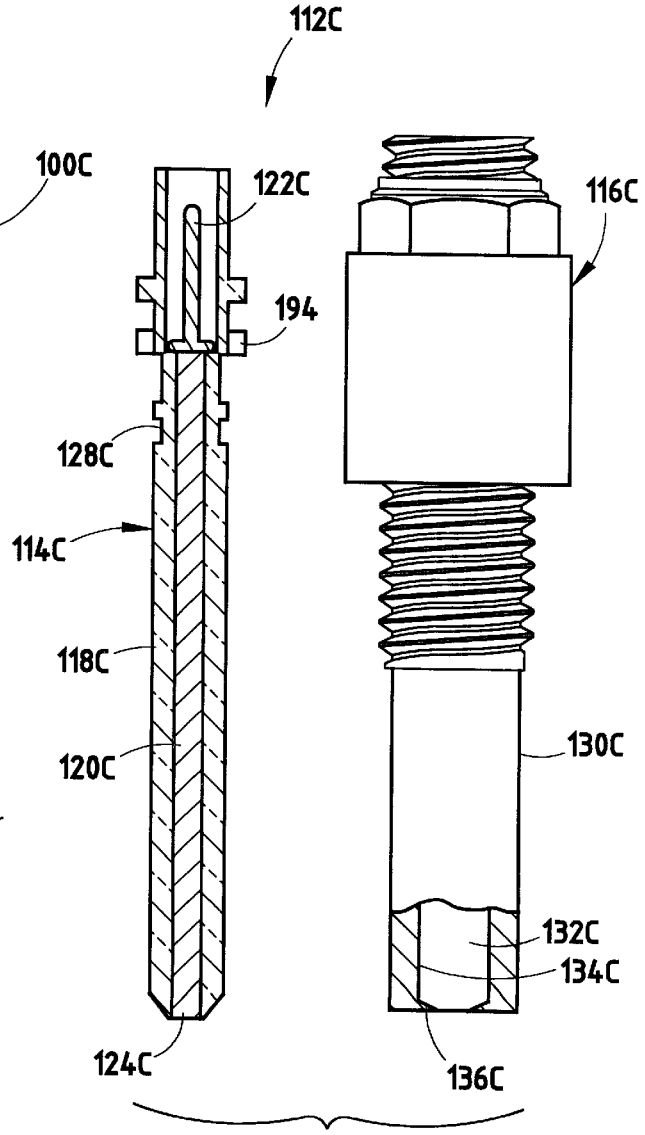
FIG. 36 is a front elevational view of the gas turbine igniter with the second alternative embodiment of the present invention, and with the igniter member shown in cross section and the housing member partially cut away.

In another application of the quick connect assembly of the present invention, the quick connect assembly is used within a gas turbine igniter 112C (FIG. 36) such as that used in conjunction with gas turbine engines. Gas turbine igniter 112C is provided with a cylindrical igniter member 114C and a cylindrical body member or outer housing 116C. Igniter member 114C is provided with a ceramic insulator element 118C and axially extending inner electrode 120C having a proximal end 122C adapted for connection with an electrical supply and a distal end 124C. Preferably, a high tensile strength, fiber reinforced ceramic is used for insulator 118C, such as that described above in relation to spark plug 10. Insulator element 118 is provided with a circumferential annular groove 128C, and a plurality of outwardly extending projections 194. Groove 128C is adapted to receive a seal (not shown) therein, thereby preventing the pressure generated within the combustion area of the associated gas turbine engine from escaping through gas turbine igniter 112C. Groove 128C and the associated seal may be replaced with other suitable arrangements adequate to prevent the pressure generated within the combustion area from escaping from gas turbine igniter 112.

Outer housing 116C is constructed similar to outer housing 12C of spark plug 10C, and is provided with a metal housing section 130C having an internal passage 132C defining an inner wall 134C and distally located outer electrodes 136C. Inner wall 134C is provided with a plurality of inwardly extending projections (not shown) adapted to engage with projections 194 of igniter member 114C.

In assembly, igniter member 114C of gas turbine igniter 112C is assembled and disassembled with outer housing 116B of gas turbine igniter 112C similar to spark plug 10C. Further, igniter member 114C is located within outer housing 116C such that distal end 124C of inner electrode 120C is in close proximity to outer electrodes 136C of metal housing section 130C, thereby allowing a spark to be generated between distal end 124C of inner electrode 120C and outer electrode 136C of metal housing section 130C.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A two-piece igniter, comprising:

an outer housing including a cylindrical member having an outer wall and an inner wall, the inner wall defining a passage through the outer housing, the inner wall having a first profile defining a first diameter and a second profile defining a second diameter, the first profile having at least one undercut section;

a plug member adapted to fit within the passage of the outer housing and including an axial electrode and an electrically insulating insulator element encircling the axial electrode, the axial electrode having a first end for connection to an electric source and a second end for engagement within a combustion area, the plug member having a first profile and a second profile, the second profile adapted to be received within the at least one undercut section of the first profile of the outer housing; and a longitudinally extending biasing member positioned about the plug member; and wherein the plug member may be releasably coupled within the outer housing by inserting the plug member within the passage of the outer housing and turning the plug member with respect to the outer housing, thereby locating the second profile of the plug member within the at least one undercut section of the first profile of the outer housing, and wherein the biasing member biases the second profile of the plug member into engagement with the at least one undercut section of the first profile of the outer housing.

2. The igniter described in claim 1, wherein the second profile of the inner wall of the outer housing includes a circumferentially extending annular groove that forms a circumferentially extending annular wall between the first and second profiles of the inner wall and within which the at least one undercut section extends.

3. The igniter described in claim 2, wherein the inner wall of the outer housing is provided with at least one longitudinally extending channel adapted to provide the second profile of the plug member access to the groove of the outer housing.

4. The igniter described in claim 3, wherein the biasing member includes a spring biasing the second profile of the plug member into engagement with the at least one undercut section.

5. The igniter described in claim 4, wherein the spring is fixedly attached to the outer housing.

6. The igniter described in claim 4, wherein the spring is fixedly attached to the plug member.

7. The igniter described in claim 6, wherein the second profile of the plug member includes a first flange and a second flange juxtaposed across the plug member, and wherein the at least one channel of the outer housing includes a first channel and a second channel juxtaposed across the outer housing, such that aligning the first and second flanges with the first and second channels requires a maximum of 180° of rotation of the plug member with respect to the outer housing.

8. The igniter described in claim 6, wherein the second profile of the plug member includes a first flange, a second flange and a third flange spaced equidistant about the plug member, and wherein the at least one channel of the outer housing includes a first channel, a second channel and a third channel spaced equidistant about the outer housing, such that aligning the first, second and third flanges with the first, second and third channels requires a maximum of 120° of rotation of the plug member with respect to the outer housing.

9. The igniter described in claim 8, wherein the undercut sections are spaced along the annular wall of the outer housing, such that locating the first, second and third flanges within the undercut sections requires a maximum of 60° of rotation of the plug member with respect to the outer housing.

10. The igniter described in claim 9, wherein the igniter is a two-piece spark plug.

11. The igniter described in claim 9, wherein the igniter is a two-piece glow plug.

12. The igniter described in claim 9, wherein the igniter is a two-piece gas turbine igniter.

13. The igniter described in claim 1, wherein the second profile of the plug member includes a first flange and a second flange juxtaposed across the plug member, and wherein the at least one channel of the outer housing includes a longitudinally extending first channel and a longitudinally extending second channel each adapted to receive the first flange and second flange therein, respectively, and juxtaposed across the outer housing, such that aligning the first and second flanges with the first and second channels requires a maximum of 180° of rotation of the plug member with respect to the outer housing.

14. The igniter described in claim 1, wherein the second profile of the plug member includes a first flange, a second flange and a third flange spaced equidistant about the plug member, and wherein the inner wall of the outer housing includes a longitudinally extending first channel, a longitudinally extending second channel and a longitudinally extending third channel each adapted to receive the first, second and third flanges therein, and spaced equidistant about the outer housing, such that aligning the first, second and third flanges with the first, second and third channels requires a maximum of 120° of rotation of the plug member with respect to the outer housing.

15. The igniter described in claim 1, wherein the at least one undercut section is spaced along the annular wall of the outer housing, such that locating the second profile of the plug member with the at least one undercut section requires a maximum of 60° of rotation of the plug member with respect to the outer housing.

16. The igniter described in claim 1, wherein the igniter is a two-piece spark plug.

17. The igniter described in claim 1, wherein the igniter is a two-piece glow plug.

18. The igniter described in claim 1, wherein the igniter is a two-piece gas turbine igniter.

19. A two-piece igniter, comprising:

an outer housing including a cylindrical member having an outer wall and an inner wall, the inner wall defining a passage through the outer housing, the outer housing further including at least one first biasing member and at least one engagement member inwardly biased by the first biasing member moveable such that the engagement member extends within the passage;

a plug member adapted to fit within the passage of the outer housing and including an axial electrode and an electrically insulating insulator element encircling the axial electrode, the axial electrode having a first end for connection to an electric source and a second end for engagement within a combustion area, the insulator element including a circumferential annular groove adapted to receive the engagement member of the outer housing therein; and a longitudinally extending second biasing member positioned about the plug member; and wherein the plug member may be releasably coupled within the outer housing by inserting the plug member within the passage of the outer housing to an engagement position where the engagement member of the outer housing engages the annular groove of the insulator element of the plug member, and wherein the plug member may be uncoupled within the outer housing by moving the plug member beyond the engagement position, thereby compressing the second biasing member, and then removed from within the outer housing with assistance from the second biasing member.

20. The igniter described in claim 19, wherein the engagement member is a ball bearing.

21. The igniter described in claim 20, wherein the second biasing member is a spring.

22. The igniter described in claim 21, wherein the first biasing member is a spring.

23. The igniter described in claim 22, wherein the second biasing member is fixedly attached to the outer housing.

24. The igniter described in claim 23, wherein the second biasing member is fixedly attached to the plug member.

25. The igniter described in claim 24, wherein the igniter is a two-piece spark plug.

26. The igniter described in claim 24, wherein the igniter is a two-piece glow plug.

27. The igniter described in claim 24, wherein the igniter is a two-piece gas turbine igniter.

28. The igniter described in claim 19, wherein the second biasing member is a spring.

29. The igniter described in claim 19, wherein the igniter is a two-piece spark plug.

30. The igniter described in claim 19, wherein the igniter is a two-piece glow plug.

31. The igniter described in claim 19, wherein the igniter is a two-piece gas turbine igniter.

32. A two-piece igniter, comprising:

an outer housing including a cylindrical member having an outer wall and an inner wall, the inner wall defining a passage through the outer housing, the inner wall having at least one inwardly extending first projection;

a plug member adapted to fit within the passage of the outer housing and including an axial electrode and an electrically insulating insulator element encircling the axial electrode, the axial electrode having a first end for connection to an electric source and a second end for engagement within a combustion area, the plug member having at least one outwardly extending second projection adapted to engage the first projection of the outer housing; and a longitudinally extending biasing member positioned about the plug member and exerting both a linear and rotation force on the plug member as the biasing member is compressed; and wherein the plug member may be releasably coupled within the outer housing by inserting the plug member within the passage of the outer housing and placing an inwardly directed first force on the plug member until the first and second projections are engaged and then releasing the first force, and wherein the plug member may be uncoupled from within the outer housing by placing an inwardly directed second force on the plug member until the first and second projection are not engaged and then releasing the second force and removing the plug member from within the outer housing.

33. The igniter described in claim 32, wherein the biasing member includes a spring.

34. The igniter described in claim 33, wherein the spring includes an hour-glass shaped spring.

35. The igniter described in claim 33, wherein the spring includes a conical helical spring.

36. The igniter described in claim 35, wherein the first projection of the outer housing has a notch that is adapted to receive at least a portion of the second projection of the plug member therein.

37. The igniter described in claim 36, wherein the first projection includes a side wall and a bottom wall that includes the notch, and wherein the second projection includes a side wall and a top wall, the top wall of the second projection mating with the notch of the bottom wall of the first projection, such that the linear force of the spring forces the second projection into engagement within the notch of the first projection when the first force is released.

38. The igniter described in claim 37, wherein the first projection includes a side wall that prohibits the rotation of the plug member with respect to the outer housing when the second projection contacts the side wall of the first projection when the second force is applied.

39. The igniter described in claim 38, wherein the igniter includes a two-piece spark plug.

40. The igniter described in claim 38, wherein the igniter includes a two-piece glow plug.

41. The igniter described in claim 38, wherein the igniter includes a two-piece gas turbine igniter.

42. The igniter described in claim 32, wherein the plug member includes a locking collar that rotates about the insulator and which includes the second projection.

43. The igniter described in claim 42, wherein the biasing member includes a spring.

44. The igniter described in claim 43, wherein the spring includes a conical helical spring.

45. The igniter described in claim 44, wherein the first projection of the outer housing has a notch that is adapted to receive at least a portion of the second projection of the plug member therein.

46. The igniter described in claim 45, wherein the first projection includes a bottom wall that includes the notch, and wherein the second projection includes a top wall, the top wall of the second projection mating with the notch of the bottom wall of the first projection, such that the linear force of the spring forces the second projection into engagement within the notch of the first projection when the first force is released.

47. The igniter described in claim 46, wherein the first projection includes a side wall that prohibits the rotation of the locking collar with respect to the outer housing when the second projection contacts the side wall of the first projection when the second force is applied.

48. The igniter described in claim 47, wherein the igniter includes a two-piece spark plug.

49. The igniter described in claim 47, wherein the igniter includes a two-piece glow plug.

50. The igniter described in claim 47, wherein the igniter includes a two-piece gas turbine igniter.

51. The igniter described in claim 42, wherein the biasing member includes a conical helical spring.

52. The igniter described in claim 42, wherein the first projection of the outer housing has a notch that is adapted to receive at least a portion of the second projection of the plug member therein.

53. The igniter described in claim 42, wherein the first projection includes a bottom wall that includes the notch, and wherein the second projection includes a top wall, the top wall of the second projection mating with the notch of the bottom wall of the first projection, such that the linear force of the spring forces the second projection into engagement within the notch of the first projection when the first force is released.

54. The igniter described in claim 42, wherein the igniter includes a two-piece spark plug.

55. The igniter described in claim 42, wherein the igniter includes a two-piece glow plug.

56. The igniter described in claim 42, wherein the igniter includes a two-piece gas turbine igniter.

57. A method, comprising:

providing an outer housing including a cylindrical member having an outer wall and an inner wall, the inner wall defining a passage through the outer housing;

providing a plug member adapted to fit within the passage of the outer housing and including an axial electrode and an electrically insulating insulator element encircling the axial electrode, the axial electrode having a first end for connection to an electric source and a second end for engagement within a combustion area;

providing a first biasing member positioned about the plug member;

inserting the plug member within the outer housing;

applying an axially directed first force to the plug member, thereby compressing the biasing member; and releasing the axially directed first force, thereby releasably locking the plug member within the outer housing.

58. The method described in claim 57, further including:

applying an axially directed second force to the plug member, thereby compressing the biasing member; and, releasing the axially directed second force, thereby releasing the plug member from locking engagement with the outer housing.

59. The method described in claim 58, wherein the first force applying step includes an operator applying an axially directed force only, and wherein the first biasing member exerts a rotationally directed force on the plug member.

60. The method described in claim 59, wherein the outer housing providing step includes providing the inner wall with at least one inwardly extending first projection, wherein the plug member providing step includes providing the plug member with at least one outwardly extending second projection adapted to engage the first projection of the outer housing, and wherein the step of applying the axially directed force causes the first biasing member to exert the rotationally directed force on the plug member, thereby causing the second projection to engage the first projection.

61. The method described in claim 57, wherein the step of providing the outer housing includes providing the outer housing with at least one second biasing member and at least one engagement member inwardly biased by the first biasing member such that the engagement member extends within the passage, and wherein the step of providing the plug member includes providing the insulator of the plug member with a circumferential annular groove adapter to receive the engagement member of the outer housing therein.

62. A method of coupling a two-piece igniter, comprising:

providing an outer housing including a cylindrical member having an outer wall and an inner wall that defines a passage through the outer housing, the inner wall having a first profile defining a first diameter and a second profile defining a second diameter, the first profile having at least one inwardly extending step;

providing a plug member adapted to fit within the passage of the outer housing, the plug member including an axial electrode and an electrically insulating insulator element encircling the axial electrode, the axial electrode having a first end for connection to an electric source and a second end for engagement within a combustion area, the plug member having a first profile defining a first diameter and a second profile defining a second diameter;

providing a longitudinally extending biasing member positioned about the plug member and adapted to outwardly bias the plug member from within the outer housing;

inserting the plug member within the passage of the outer housing;

exerting an inwardly directed force on the plug member, thereby depressing the biasing member;

turning the plug member with respect to the outer housing until the second profile of the plug member is rotated beyond the at least one step of the outer housing; and releasing the inwardly directed force on the plug, such that the at least one step of the outer housing restricts the member plug member from being rotated with respect to the outer housing.

63. The method described in claim 62, wherein the outer housing providing step includes providing the outer housing with at least one longitudinally extending channel adapted to provide the second profile of the plug member access to the groove of the outer housing.

64. The method described in claim 62, wherein the outer housing providing step includes providing the outer housing with a longitudinally extending first channel and a longitudinally extending second channel juxtaposed across the outer housing, wherein the plug member providing step includes providing the second profile of the plug member with a first flange and a second flange juxtaposed across the plug member and adapted to be received within the first channel and second channel, and wherein the step of turning the plug member requires a maximum of 180° of rotation of the plug member with respect to the outer housing to align the flanges with the channels.

65. The method described in claim 64, wherein outer housing providing step includes providing a first step corresponding to the first flange and a second step corresponding to the second flange.

66. The method described in claim 62, wherein the outer housing providing step includes providing the outer housing with a longitudinally extending first channel, a longitudinally extending second channel and a longitudinally extending third channel spaced equidistantly about the outer housing, wherein the plug member providing step includes providing the second profile of the plug member with a first flange, a second flange and a third flange spaced equidistantly about the plug member and adapted to be received within the first channel, second channel and third channels, and wherein the step of turning the plug member requires a maximum of 120° of rotation of the plug member with respect to the outer housing to align the flanges with the channels.

67. The method described in claim 66, wherein outer housing providing step includes providing a first step corresponding to the first flange, a second step corresponding to the second flange, and a third step corresponding to the third flange.

68. The method described in claim 62, wherein the outer housing providing step includes locating the at least one step within the outer housing such that the step of turning the plug member until the second profile of the plug is rotated beyond the at least one step, requires a maximum of 60° of rotation of the plug member with respect to the outer housing.

69. A method, comprising:

providing an outer housing including a cylindrical member having an outer wall and an inner wall, the inner wall defining a passage through the outer housing, the inner wall having at least one inwardly extending first projection;

providing a plug member adapted to fit within the passage of the outer housing, the plug member including an axial electrode and an electrically insulating insulator element encircling the axial electrode, the axial electrode having a first end for connection to an electric source and a second end for engagement within a combustion area, the plug member having at least one outwardly extending second projection adapted to engage the first projection of the outer housing;

providing a biasing member positioned about the plug member and that exerts both a linear and rotational force on the plug member as the biasing member is compressed;

inserting the plug member within the outer housing;

applying an inwardly directed first force to the plug member until the spring aligns the second projection with the first projection, thereby engaging the second projection with the first projection and releasably locking the plug member within the outer housing; and releasing the inwardly directed first force.

70. The method described in claim 69, wherein the biasing providing step includes providing a spring.

71. The method described in claim 70, wherein the spring of the biasing member providing step has an hour-glass-type shape.

72. The method described in claim 70, wherein the spring of the biasing member providing step is a conical helical spring.

73. The method described in claim 72, wherein igniter described in claim 35, wherein the first projection of the outer housing has a notch that is adapted to receive at least a portion of the second projection of the plug member therein.

74. The igniter described in claim 73, wherein the igniter includes a two-piece spark plug.

75. The igniter described in claim 73, wherein the igniter includes a two-piece glow plug.

76. The igniter described in claim 73, wherein the igniter includes a two-piece gas turbine igniter.

77. The igniter described in claim 69, wherein the igniter includes a two-piece spark plug.

78. The igniter described in claim 69, wherein the igniter includes a two-piece glow plug.

79. The igniter described in claim 69, wherein the igniter includes a two-piece gas turbine igniter.

* * * * *

UNITED STATES PATENT AND TRADEMARK OFFICE

CERTIFICATE OF CORRECTION

PATENT NO. : 6,363,898 B1
DATED : April 2, 2002
INVENTOR(S) : Ripma et al.

It is certified that error appears in the above-identified patent and that said Letters Patent is hereby corrected as shown below:

Column 1,
Line 55, delete "the" (second occurrence).

Column 2,
Line 59, delete "two".

Column 3,
Line 41, "protection" should be -- projection --.

Column 8,
Line 6, "location 90º" should be -- located 90º --.

Column 9,
Line 2, delete "or" (second occurrence).

Column 10,
Line 44, "igniter member 112" should be -- igniter member 114 --.
Line 49, "proximately" should be -- proximity --.

Column 11,
Line 17, "area 361" should be -- area 36B --.
Line 67, "groove 1103B" should be -- groove 110B --.

Column 13,
Line 17, "end 345C" should be -- end 34C --.
Line 37, delete "a".
Line 50, "outer housing 160" should be -- outer housing 12C --.

Column 21,
Line 36, delete "member" (1st occurrence).
Line 54, after "wherein" insert -- the --.

UNITED STATES PATENT AND TRADEMARK OFFICE

CERTIFICATE OF CORRECTION

PATENT NO. : 6,363,898 B1
DATED : April 2, 2002
INVENTOR(S) : Ripma et al.

It is certified that error appears in the above-identified patent and that said Letters Patent is hereby corrected as shown below:

Column 22,
Line 4, after "wherein" insert -- the --.
Lines 50-51, after "72" delete "wherein igniter described in claim 35,".

Signed and Sealed this

Eighth Day of October, 2002

*Attest:*

*Attesting Officer*

JAMES E. ROGAN
*Director of the United States Patent and Trademark Office*